United States Patent [19]

Mihayashi et al.

[11] Patent Number: 4,952,488

[45] Date of Patent: Aug. 28, 1990

[54] SILVER HALIDE COLOR PHOTOGRAPHIC MATERIAL AND PROCESSING PROCESS THEREFOR

[75] Inventors: Keiji Mihayashi; Akira Abe; Yoshihiko Shibara; Shinji Ueda; Shunishi Aida; Hiroshi Fujimoto, all of Kanagawa, Japan

[73] Assignee: Fuji Photo Film Co., Ltd., Kanagawa, Japan

[21] Appl. No.: 206,981

[22] Filed: Jun. 13, 1988

Related U.S. Application Data

[63] Continuation-in-part of Ser. No. 939,846, Dec. 9, 1986, abandoned.

[30] Foreign Application Priority Data

| | | | |
|---|---|---|---|
| Dec. 9, 1985 | [JP] | Japan | 60-276621 |
| Dec. 10, 1985 | [JP] | Japan | 60-277591 |
| Dec. 11, 1985 | [JP] | Japan | 60-278579 |

[51] Int. Cl.[5] ..... G03C 1/34; G03C 7/34

[52] U.S. Cl. ..... 430/551; 430/552; 430/553; 430/567; 430/430

[58] Field of Search ..... 430/552, 553, 551, 393, 430/430, 460, 461, 567

[56] References Cited

U.S. PATENT DOCUMENTS

| | | | |
|---|---|---|---|
| 3,647,469 | 3/1972 | Huckstadt et al. | 430/551 |
| 4,186,008 | 1/1980 | Schar et al. | 430/393 |
| 4,458,010 | 7/1984 | Yamamuro et al. | 430/393 |
| 4,552,834 | 11/1985 | Lau et al. | 430/393 |
| 4,596,764 | 6/1986 | Ishimaru | 430/393 |
| 4,607,004 | 8/1986 | Ikenoue et al. | 430/551 |
| 4,621,047 | 11/1986 | Kishimoto et al. | 430/393 |
| 4,659,654 | 4/1987 | Metoki et al. | 430/567 |
| 4,666,825 | 5/1987 | Shimba et al. | 430/393 |
| 4,668,614 | 5/1987 | Takada et al. | 430/567 |
| 4,707,434 | 11/1987 | Koboshi et al. | 430/393 |

*Primary Examiner*—Paul R. Michl
*Assistant Examiner*—Mark R. Buscher
*Attorney, Agent, or Firm*—Sughrue, Mion, Zinn, Macpeak & Seas

[57] ABSTRACT

Silver halide color photographic materials, and processes for processing photographic materials, are described, involving the use of at least one of a compound represented by formula (I) and a compound represented by formula (II)

(I)

(II)

wherein A represents an n-valent aliphatic linkage group, an aromatic linkage group or a heterocyclic group (when n is 1, A represents an aliphatic group, aromatic group, heterocyclic group, or hydrogen atom); X represents —O—, —S—, or (wherein, $R^4$ represents a lower alkyl group); $R^1$ and $R^2$ each represents a substituted or unsubstituted lower alkyl group; $R^3$ represents a lower alkylene group; said $R^1$ and $R^2$, said $R^1$ and A, said $R^1$ and $R^3$, said $R^2$ and A, or said $R^2$ and $R^3$ combine with each other to form a ring; Y represents an anion; l represents 0 or 1; m represents 0 or 1; n represents 1, 2, or 3; p represents 0 or 1; q represents 0, 1, 2, or 3; when n is 2 or 3, the substituents bonding to A are the same or different; r represents 1, 2, or 3; $R^{11}$ and $R^{12}$ each represents a hydrogen atom, an alkyl group, or an acyl group, except that $R^{11}$ and $R^{12}$ do not both represent hydrogen atom at the same time; or $R^{11}$ and $R^{12}$ combine with each other to form a ring.

5 Claims, No Drawings

SILVER HALIDE COLOR PHOTOGRAPHIC MATERIAL AND PROCESSING PROCESS THEREFOR

This is a continuation-in-part of application Ser. No. 06/939,846 filed Dec. 9, 1986, now abandoned.

FIELD OF THE INVENTION

This invention relates to silver halide color photographic materials and a process for processing them. More particularly, the invention relates to silver halide color photographic materials very excellent in development and silver removal processing aptutude and color image hastness and also a process for processing the color photographic materials.

BACKGROUND OF THE INVENTION

The fundamental processing steps for color photographic materials are a color development step and a desilvering step. In the color development step, light-exposed silver halides are reduced by a color developing agent to form silver and the oxidized color developing agent reacts with color formers (couplers) to provide dye images. In the subsequent desilvering step, silver formed in the color development step is oxidized by the action of an oxidizing agent (called as bleaching agent) and then dissolved by a complexing agent for silver ion called as a fixing agent. By the desilvering step, solely dye images are formed in the color photographic material.

The above-described desilvering step is usually performed by two baths, i.e., a bleach bath containing a bleaching agent and a fix bath containing a fixing agent or by one bath, i.e., a blix bath containing a bleching agent and a fixing agent together.

In general, as the bleaching agent, ferricyanides, dichromates, ferric chloride, aminopolycarboxylic acid metal complex salts, and persulfates were used but recently aminopolycarboxylic acid metal complex salts have been used from the problems of toxicity and safety.

However, aminopolycarboxylic acid metal complex salts have the problems that the oxidative power thereof is weak, whereby the bleaching speed of developed silver is slow, and also the density of cyan dye images formed in a color developer solution is reduced (fluctuated).

For solving these problems, there is provided a method of adding a bleach accelerator to a bleach bath, a blix bath, or a pre-bath thereof as described, for example, in U.S. Pat. No. 3,893,858, Japanese Patent Application (OPI) Nos. 95630/77, 26506/80, 42349/74, 52534/79, 5630/74, Japanese Patent Publication Nos. 8506/70, 2586/74, etc. (The term "OPI" as used herein means an "unexamined published patent application). However, in the above method, a satisfactory bleach accelerating effect is not always obtained or sparingly soluble precipitates are formed with the increase of the amount of the processed color photographic materials.

Thus, a method of accelerating the bleaching by adding a compound similar to the compounds represented by formula (I) described hereinafter, which are used in this invention, to color photographic light-sensitive materials or the processing solution is proposed in U.S. Pat. No. 4,552,834 but the patent does not disclose a combination of the compound and a cyan coupler as in the present invention.

Also, as a method for accelerating a bleach and/or a blix, processing color photographic materials at such a low pH as an aminopolycarboxylic acid metal complex salt strongly functions its oxidative power has been performed, but in their method, there are problems in that a cyan dye density is liable to lower and also a thiosulfate or a sulfite existing in the processing solution is decomposed fast to make the performance of the processing solution unstable.

On the other hand, the increase of the pH of the bleaching or blixing solution encounters the problems that the desilvering property is reduced and also the formation of color fog at unexposed portions is increased.

For eliminating these disadvantages, phenolic cyan couplers having a phenylureido group at the 2-position and a carbonamido group at the 5-position, which is reluctant to reduce the cyan image density in the case of processing with a bleach solution or a blix solution having a weak oxidative power or a bleach solution or a blix solution having low pH are proposed in Japanese Patent Application (OPI) Nos. 65134/81, 204543/82, 204544/82, 204545/82, 33249/83, 33250/83, etc. However, even when these cyan couplers are used, a thiosulfate or a sulfite co-existing in a bleach solution or a blix solution is decomposed at a low pH range to make the performance of the cyan couplers unstable and the desilvering speed can not be said to be satisfacturily.

For further improving the above-described techniques, a method of processing a color photographic light-sensitive material containing the cyan coupler, which is used in the present invention, with a blix solution containing a diethylenetriaminepentaacetic acid iron (III) complex salt and having a pH of at least 4.0 is proposed in Japanese Patent Application (OPI) No. 151154/84 but the effect is obtained only in the case of using a blix solution containing a limited bleaching agent and also the effect is small.

Accordingly, the developments of a color photographic light-sensitive material which shows a high desilvering speed (bleaching or blixing speed), can be stably processed, does not result in fluctuations of the cyan image density by processing, and has high fastness and also a processing system for the color photographic material, have been keenly desired.

Also, since the requirement for a high image quality of a silver halide color photographic material has recently become more and more severe and, in particular, the decrease of picture size of a photographic light-sensitive material with the decrease of the size of cameras has been desired, the requirement for the development of the technique about the improvement of image quality (in particular, graininess) in a color photographic light-sensitive material has become very strong.

As the techniques for improving the graininess of color photographic materials, a method of increasing the utilization effect of incident light in the color photographic materials by using core/shell type silver halide emulsion grains of a two-layer composed of a core portion having a high silver iodide content in the inside of the emulsion grain and a shell portion having a low silver iodide content to separately provide the functions from the light receiving to the image formation as well as possible as described, for example, in Japanese Patent Application (OPI) Nos. 153428/77, 138538/85, 143331/85, and *Journal of Imaging Science*, Vol. 29, No. 5, page 193 is useful.

On the other hand, recently, with the increase of the employment of so-called mini-laboratory, the requirement for simplicity and quicker processing of color photographic materials and the lowering of the cost for processing has become severe and the simplification of processing steps, the shortening of processing time, and the reduction of the amount of processing chemicals have become inevitably required.

In particular, when a color photographic light-sensitive material containing a silver halide emulsion having a phase of high silver iodide content as the two-layer structure silver halide grains as described above is processed, the bleaching speed is liable to be delayed, and hence there is a serious problem that the desilvering becomes poor.

By the reasons described above, the desilvering technique for the color photographic materials using a silver halide emulsion having a phase of high silver iodide content has not yet been established at present and also the improvement for the desilvering processing of color photographic materials containing a silver halide emulsion having a phase of high silver iodide content has not yet been developed.

Still further, for obtaining good color image quality in the case of forming color photographic images, it is important that the change in finish property of the development in the case of processing color photographic materials is less. For realizing the aforesaid matter, it is effective that the formation of fog in the case of processing color photographic materials is less and also the change in fog during the storage of color photographic materials is less. Since in the case of processing color photographic materials giving high fog, the difference in fog between the case of developing under the development condition of liable to forming fog by the increase of the temperature of the developer solution or the increase of the pH thereof and the case of developing under the development condition of being resistant to the formation of fog by the decrease of the temperature or the pH of the developer solution is liable to become larger, the fluctuation of the development finish property is liable to become larger as the result, thereof. Also, as a matter of course, color photographic materials giving large change of fog when stored in the undeveloped state are liable to cause the fluctuations in the development finish property.

As one of means for solvent the problems of preventing the occurrence of fog of such silver halide color photographic materials and of preventing the increase of fog formation by storing the color photographic materials in the undeveloped state, it is known to incorporate various antifoggants into color photographic materials.

That is, it is known that heterocyclic mercapto compounds such as mercaptothiazoles, mercaptobenzthiazoles, mercaptobenzimidazoles, mercaptothiadiazoles, mercaptotetrazoles (in particular, 1-phenyl-5-mercaptotetrazole), mercaptopyrimidines, etc., have a remarkable effect for the prevention of the formation of fog and also for the prevention of the increase of fog when color photographic materials are stored in the undeveloped state.

In particular, it is described in Japanese Patent Publication No. 9939/83 that the inhibition of the formation of fog at color photographic processing of color photographic materials and the prevention of the increase of fog at the storage of color photographic materials under the undeveloped state can be realized without reducing the sensitivity of the color photographic materials by the use of a compound similar to the compounds represented by formula (III) described hereinafter, which are used in the present invention. However, there are no descriptions in the aforesaid patent about the influences of the compound similar to the compounds represented by formula (III) in this invention on the bleach or blix processing, the effect of incorporating the compound similar to the compounds of formula (III) in color photographic materials together with the compound represented by formula (I) and/or the compound represented by formula (II) in this invention, which is described hereinafter, and the effect of the case of color photographic processing color photographic materials containing the compound similar to the compounds of formula (III) in the existence of the compound represented by formula (I) and/or the compounds represented by formula (II) in this invention.

Also, in British Patent No. 1,138,842, Japanese Patent Publication Nos. 4980/85, 6506/85, 6508/85, 16616/85, Japanese Patent Application (OPI) Nos. 61749/85, 95540/85, and 125843/85, it is described that by adding a compound having a mercapto group to a bleach bath, a blix bath or a pre-bath therefor, a bleach accelerating effect is obtained. However, since, for example, the compounds disclosed in Japanese Patent Publication No. 6506/85 described above do not have a substituent such as —COOH, —$SO_3H$, —$NR^2R^2$, etc., while the compounds disclosed in Japanese Patent Publication No. 6508/85 have —COOH as the substituent, it is very difficult to estimate the bleach accelerating effect from the chemical structure of a compound for use.

Furthermore, the above-described patents and patent applications all describe the effect only in the case of incorporating the compound having a mercapto group in processing solution and there are no descriptions therein about preferred chemical structures of the compounds incorporated in color photographic materials.

Japanese Patent Application (OPI) No. 127038/84 discloses that a color photographic material containing a mercapto compound having an amino group and 1-phenyl-5-mercaptotetrazole having an amido group as a combination thereof is excellent in storability and shows an improved bleaching property, but the invention described therein relates to a color photographic processing using a persulfate as a bleaching agent. However, since a persulfate has a weaker oxidative power than an aminopolycarboxylic acid metal salt and shows a slow desilvering speed for developed silver, it is difficult to anticipate whether or not the combination disclosed in the aforesaid patent application is also effective in a color photographic processing using an aminopolycarboxylic acid metal salt as a bleaching agent. Moreover, when a persulfate is precipitated from the processing solution, there is a possibility of causing explosion.

Accordingly, means for improving the bleaching property in a color photographic processing process using a safe aminopolycarboxylic acid metal salt as a bleaching agent have been strongly desired.

Also, Japanese Patent Application (OPI) No. 168049/83 describes that a color photographic material containing a compound having a partial structure of $$-\underset{\underset{O}{\|}}{NHCS}-$$

and 1-phenyl-5-mercaptotetrazole as a combination thereof shows less change of performance when the color photographic material is stored for a long period of time and shows an imProved bleaching property in the color photographic processing using an aminopolycarboxylic acid metal salt as a bleaching agent. However, the effect is still unsatisfactory.

Accordingly, from these circumstances, the developments of color photographic materials having safer shelf life and a color photographic system having improved bleaching property have been strongly desired.

In this respect, a method of accelerating bleaching by adding a compound similar to the compounds represented by formula (I) in the present invention is proposed in U.S. Pat. No. 4,552,834 but this patent does not disclose a combination of the compound with a mercapto compound as well as does not teach a method of both accelerating the bleaching and reducing the change of the performance by the storage for a long period of time.

Also, a method of accelerating the bleaching by adding a compound similar to the compounds represented by formula (II) described hereinafter, which are used in the present invention, to the processing solution is proposed in Japanese Patent Application (OPI) No. 95630/78, but a combination of the compound and a mercapto compound is not disclosed in the patent application.

SUMMARY OF THE INVENTION

A first object of this invention is to provide a silver halide color photographic material having excellent color image storability and showing less fluctuation of cyan image density in the case of processing with various kinds of bleaching baths or blix baths.

A second object of this invention is to provide a silver halide color photographic material showing a high desilvering speed in bleach or blix processing.

A third object of this invention is to provide a process of processing silver halide color photographic materials with a stable bleach or blix solution showing a high desilvering speed.

A fourth object of this invention is to provide a silver halide color photographic material excellent in graininess and showing a high desilvering speed in the case of processing with various kinds of bleaching baths or blix baths.

A fifth object of this invention is to provide a process of quickly processing silver halide color photographic materials excellent in graininess.

A sixth object of this invention is to provide a silver halide color photographic material showing less change of the performance by the storage for a long time and showing a high desilvering speed.

A seventh object of this invention is to provide a color photographic process for processing color photographic materials using a stable bleach or blix solution showing a high desilvering speed.

As the result of various invetigations, the inventors have discovered that the above-described objects of this invention can be obtained by the present invention as set forth hereineblow.

That is, according to this invention, there is provided a silver halide color photographic material comprising a support having thereon at least a light-sensitive silver halide emulsion layer containing at least one kind of a phenolic cyan dye-forming coupler having an arylureido group at the 2-position and a carbonamido group at the 5-position, said color photographic material containing at least one of a compound represented by formula (I) and a compound represented by formula (II)

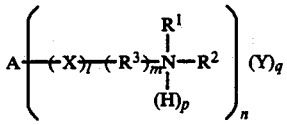

(I)

wherein A represents an n-valent aliphatic linkage group, an aromatic linkage group, or a heterocyclic group (when n=1, said A represents an aliphatic group, an aromatic group, a herocyclic group, or a hydrogen atom);

X represents —O—, —S—, or

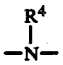

(wherein $R^4$ represents a lower alkyl group);

$R^1$ and $R^2$ each represents a substituted or unsubstituted lower alkyl group and $R^3$ represents a lower alkylene group; said $R^1$ and $R^2$, $R^1$ and A, $R^1$ and R3, $R^2$ and A, or $R^2$ and $R^3$ may combine with each other to form a ring;

Y represents an anion:

l represents 0 or 1; m represents 0 or 1; n represents 1, 2, or 3; p represents 0 to 1; and q represents 0, 1, or 3;

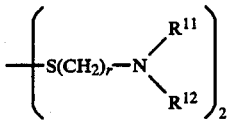

(II)

wherein $R^{11}$ and $R^{12}$ each represents a hydrogen atom, an alkyl group, or an acyl group, except that said $R^{11}$ and $R^{12}$ do not both represent hydrogen atoms, at the same time or said $R^{11}$ and $R^{12}$ combine with each other to form a ring; and r represents 1, 2, or 3.

According to other embodiment of this invention, there is provided a process for processing a silver halide color photographic material having on a support at least one light-sensitive silver halide emulsion layer containing at least one phenolic cyan dye image-forming coupler having an arylureido group at the 2-position and a carbonamide group at the 5-position by desilvering the color photographic material after color development, which comprises including a step of processing the color photographic material with a bleach bath, a blix bath, or a bath before the processing solution having bleaching faculty, said bath containing the compound represented by formula (I) described above.

Particularly, the above-described fourth and fifth objects of this invention can be attained by the following embodiments of this invention.

That is, according to still other embodiment of this invention, there is provided a silver halide color photographic material comprising a support having thereon at least one silver halide emulsion layer containing silver halide grains of a layer structure composed of a core substantially comprising silver iodobromide containing at least 10 mol% silver iodide and a shell substantially comprising silver bromide or silver iodobromide containing less than 5 mol% silver iodide, said color photographic material containing at least one of a compound represented by formula (I) and a compound represented by formula (II) described above.

According to a further embodiment of this invention, there is provided a process of processing a silver halide color photographic material having on a support at least one silver halide emulsion layer containing silver halide grains of a layer structure composed of a core substantially comprising silver iodobromide containing at least 10% silver iodide and a shell substantially comprising silver bromide or silver iodobromide containing at most 5 mol% silver iodide, which comprises processing, after color development, the color photographic material in a processing step using a bleach bath, a blix bath, or a bath before the processing solution having bleaching faculty, said bath containing at least one kind of the compounds represented by formula (I) described above.

Moreover, particularly, the above-described sixth and seventh objects of this invention can be attained by the following embodiments of this invention.

That is, according to the embodiment of this invention, there is further provided a silver halide color photographic material comprising a support having thereon at least one light-sensitive silver halide emulsion layer, said color photographic material containing at least one of a compound represented by formula (I) and the compound represented by formula (II) described above and further a compound represented by formula (III) shown below:

$$Q-SM^1 \quad \text{(III)}$$

wherein, Q represents a heterocyclic group bonded directly or indirectly to $-SO_3M^2$, $-COOM^2$, —OH, or $-NR^{21}R^{22}$ (wherein, $M^2$ represents a hydrogen atom, an alkali metal, a quaternary ammonium group, or a quaternary phosphonium group and $R^{21}$ and $R^{22}$ each represents a hydrogen atom or a substituted or unsubstituted alkyl group) and $M^1$ represents a hydrogen atom, an alkali metal, a quaternary ammonium group, or a quaternary phosphonium group.

According to another embodiment of this invention, there is also provided a process of processing a silver halide color photographic material having on a support at least one light-sensitive silver halide emulsion layer contaning the compound represented by formula (III) described above by delivering the color photographic material after color development, which comprises including a processing step using a bleach bath, a blix bath, or a bath before the processing solution having bleaching faculty, said bath containing at least one of a compound represented by formula (I) described above and the compound represented by formula (II) described above.

DETAILED EXPLANATION OF THE INVENTION

The compounds for use in this invention are described below in more detail.

In formula (I) described above showing the compound which is used for the color photographic material of this invention or in the processing solution for processing color photographic materials in the processing process of this invention, A represents an n-valent aliphatic linkage group, an aromatic linkage group, or a heterocyclic linkage group (when n is 1, however, A represents a simple aliphatic group, aromatic group, heterocyclic group, or a hydrogen atom). Preferably, when n is 1, A represents an aliphatic group, an aromatic group, or a heterocyclic group.

The aliphatic linkage group shown by A includes an alkylene group having from 3 to 12 carbon atoms (e.g., a trimethylene group, a hexamethylene group, a cyclohexylene group, etc.).

The aromatic linkage group shown by A includes an arylene group having from 6 to 18 carbon atoms (e.g., a phenylene group, a naphthylene group, etc.).

Also, the heterocyclic linkage group includes a heterocyclic group containing at least one hetero atom (e.g., oxygen atom, sulfur atom, nitrogen atom, etc.), such as a thiophene group, a furan group, a triazine group, a pyridine group, a piperidine group, etc.).

In the compound shown by formula (I), the number of the aliphatic linkage groups, aromatic linkage groups, or heterocyclic linkage groups is usually one, but two or more groups may be linked directly or through a divalent linkage group (e.g., —O—, —S—, $$-\overset{\overset{R^5}{|}}{N}-$$

(wherein $R^5$ represents a lower alkyl group), $-SO_2-$, —CO—, or a linkage group formed by a combination of these linkage groups).

Also, the aliphatic linkage group, the aromatic linkage group, and the heterocyclic linkage group each may have a substituent. Examples of the substituent are an alkoxy group, a halogen atom, an alkyl group, a hydroxy group, a carboxy group, a sulfo group, a sulfonamido group, a sulfamoyl group, etc.

X in formula (I) represents —O—, —S—, or $$-\overset{\overset{R_4}{|}}{N}-$$

(wherein $R^4$ represents a lower alkyl group such as a methyl group, an ethyl group, etc.).

$R^1$ and $R^2$ in formula (I) represent a substituted or unsubstituted lower alkyl group (e.g., a methyl group, an ethyl group, a propyl group, an isopropyl group, a pentyl group, etc.) and preferred examples of the substituent are a hydroxy group, a lower alkoxy group (e.g., a methoxy group, a methoxyethoxy group, a hydroxyethoxy group, etc.), an amino group (e.g., an unsubstituted amino group, a dimethylamino group, an N-hydroxyethyl-N-methylamino group, etc.), etc. When two or more substituents exist, they may be the same or different.

$R^3$ in formula (I) described above represents a lower alkylene group having form 1 to 5 carbon atoms (e.g., a methylene group, an ethylene group, a trimethylene group, a methylmethylene group, etc.).

Also, Y in formula (I) represents an anion (e.g., halide ion, such as chloride ion, bromide ion, etc., nitrate ion, sulfate ion, p-toluenesulfonate ion, oxalate ion, etc.).

Furthermore, said $R^1$ and $R^2$ may combine through a carbon atom or a hetero atom (e.g., oxygen atom, nitrogen atom, sulfur atom, etc.,) to form a 5-membered or 6-membered heterocyclic ring (e.g., pyrrolidine ring, piperidine ring, morpholine ring, triazine ring, imidazolidine ring, etc.).

Also, said $R^1$ (or $R^2$) and A may combine through a carbon atom or a hetero atom (e.g., oxygen atom, nitrogen atom, sulfur atom, etc.) to form a 5-membered or 6-membered heterocyclic ring (e.g., a hydroxyquinoline ring, a hydroxyindole ring, an isoindoline ring, etc.).

Furthermore, said $R^1$ (or $R^2$) and $R^3$ may combine through a carbon atom or a hetero atom (e.g., oxygen atom, nitrogen atom, sulfur atom, etc.) to form a 5-membered or 6-membered heterocyclic ring (e.g., a piperidine ring, a pyrrolidine ring, a morpholine ring, etc.).

In formula (I), l represents 0 or 1, m represents 0 or 1, n represents 1, 2, or 3, p represents 0 or 1, and q represents 0, 1, 2, or 3.

When n is 2 or more, the substituents bonding to A may be the same or different.

Specific examples of the compound represented by formula (I) for use in this invention are illustrated below, but the compounds for use in this invention are not limited to them.

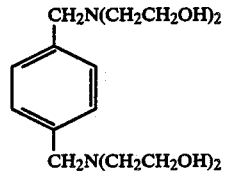

(I-1)

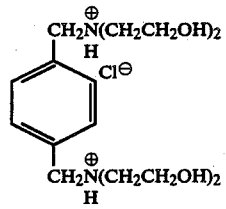

(I-2)

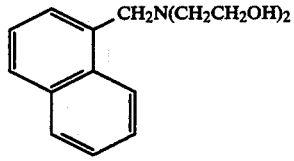

(I-3)

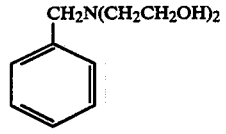

(I-4)

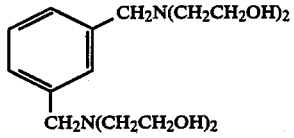

(I-5)

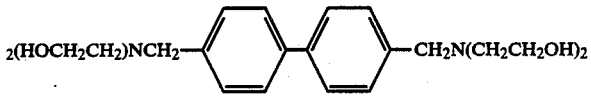

(I-6)

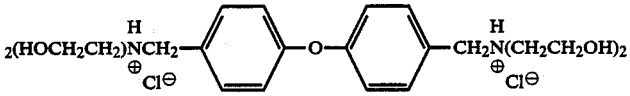

(I-7)

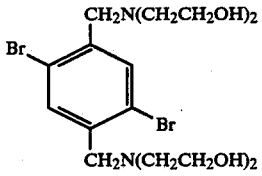

(I-8)

-continued
(I-9)
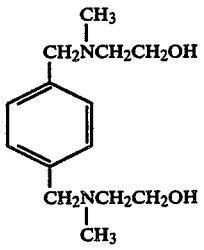
(I-10)
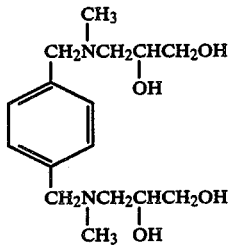
(I-11)
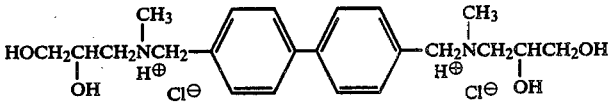
(I-12)
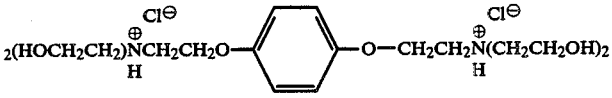
(I-13)
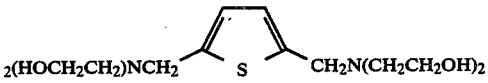
(I-14)
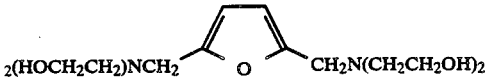
(I-15)
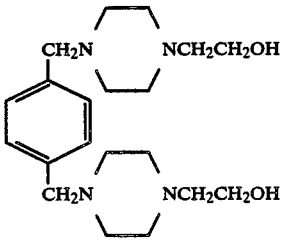
(I-16)
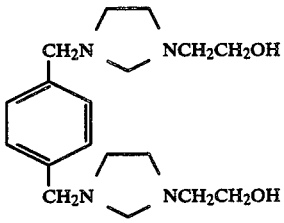

-continued (I-17)

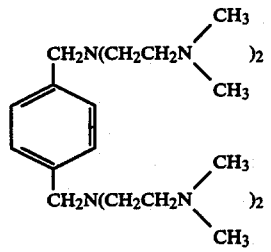

(I-18)

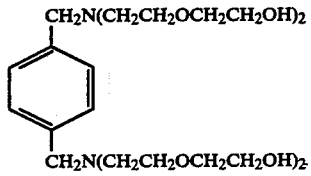

(I-19)

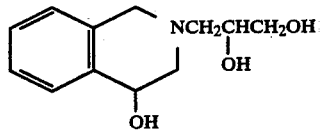

(I-20)

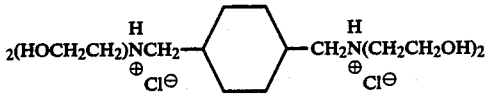

(I-21)

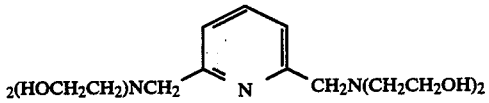

(I-22)

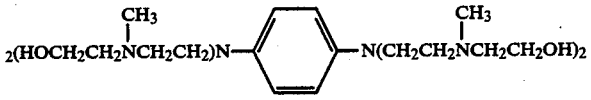

(I-23)

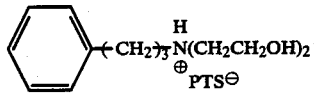

(I-24)

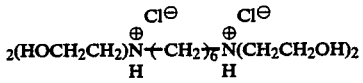

(I-25)

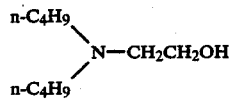

(I-26)

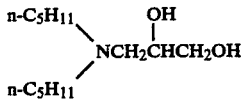

In the foregoing, PST indicates para-toluene sulfonate.

The compounds of formula (I) can be synthesized according to the methods described, for example, in U.S. Pat. No. 4,552,834, Japanese Patent Publication No. 12056/79, Japanese Patent Application (OPI) No. 192953/82, etc.

Next, the compound represented by formula (I)]described above are explained in more detail.

In formula (II), $R^{11}$ and $R^{12}$ (which may be the same or different) each represents a hydrogen atom, a substituted or unsubstituted lower alkyl group (preferably having from 1 to 5 carbon atoms, such as, in particular, a methyl group, an ethyl group, a propyl group, etc ), or an acyl group (preferably having 1 to 3 carbon atoms, such as an acetyl group, a porpionyl group, etc.), and r is an integer of 1 to 3.

Said $R^1$ and $R^{12}$ may also combine with each other to form a ring, preferably to form a 5- or 6-membered heterocyclic ring which includes a nitrogen atom and optionally another nitrogen atom or an oxygen atom in addition to the nitrogen atom as a heteroatom.

As $R^{11}$ and $R^{12}$, a substituted or unsubstituted lower alkyl group is particularly preferred.

Examples of the substituent for $R^{11}$ and $R^{12}$ are a hydroxy group, a carboxy group, a sulfo group, an alkylsulfonyl group, an amino group, etc.

Specific examples of the compound represented by formula (II) are illustrated below but the compounds for use in this invention are not limited to them.

(II)-(1)

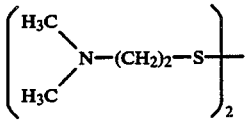

(II)-(2)

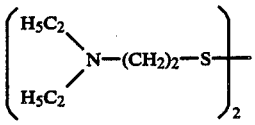

(II)-(3)

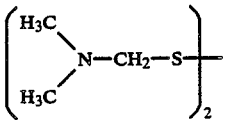

(II)-(4)

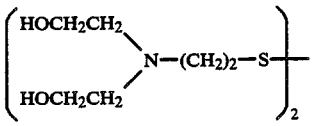

(II)-(5)

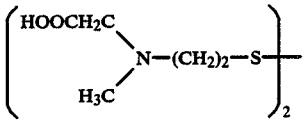

(II)-(6)

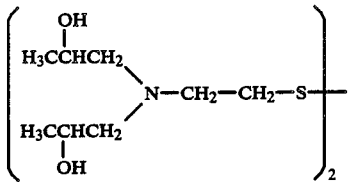

(II)-(7)

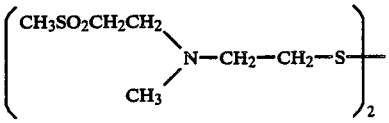

(II)-(8)

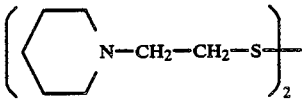

(II)-(9)

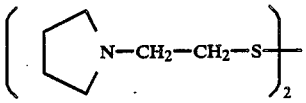

-continued (II)-(10)

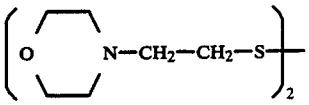

The compounds represented by formula (II) can be easily synthesized by the methods described, for example, in Japanese Patent Application (OPI) No. 95630/78.

In view of the long-term maintenance of the performance of the desilvering accelerator, a compound represented by formula (II) is preferred as compared to the compound represented by formula (II) when the desilvering accelerator is incorporated in the light-sensitive material.

When the compound of formula (I) and/or the compound of formula (II) for use in this invention is incorporated in a color photographic material, the compound(s) may be incorporated in an antihalation layer, interlayers (an interlayer between silver halide emulsion layers having different color sensitivities, an interlayer between silver halide emulsion layers having a same color sensitivity, an interlayer between a light-sensitive emulsion layer and a light insensitive layer, etc.), a light-sensitive silver halide emulsion layer, a light-insensitive silver halide emulsion layer, a yellow layer, a protectice layer, etc.) of the color photographic material. The compound(s) may be incorporated in two or more layers.

Also, two or more kinds of the compounds shown by formula (I) or (II) may be incorporated in the color photographic material. The total addition amount thereof is generally from $1\times10^{-5}$ to $1\times10^{'2}$ mol/m$^2$, preferably from $2\times10^{-5}$ to $5\times10^{-3}$ mol/m$^2$, and more preferably from $5\times10^{-5}$ to $2\times10^{-3}$ mol/m$^2$.

Also, when the compound of formula (I) and/or the compound of formula (II) is added to a bath for the processing steps in this invention, the compound is added to a bleach bath, a blix bath or a bath before the processing solution having a bleaching faculty (e.g., a development bath or a pre-bath for a bleach bath or a blix bath) but is preferably added to a development bath, a bleach bath, or a blix bath.

The addition amount of the compound to the processing bath depends upon the kind of the photographic material to be processed, the processing temperature, the time required for the processing, etc., but is generally from $2\times10^{-4}$ to $1\times10^{-1}$ mol/liter, preferably from $5\times10^{-4}$ to $5\times10^{2}$ mol/liter, and more preferably from 233 $10^{-3}$ to $5\times10^{-2}$ mol/liter.

For incorporating the compound of formula (I) and/or the compound of formula (II) in a color photographic light-sensitive material, the compound(s) can be added to a coating composition for the photographic layer either as is or as a solution thereof in a solvent giving no bad influences on the color photographic light-sensitive material, such as water, alcohol, etc. Also, the compound(s) may be dissolved in a high-boiling organic solvent and/or a low-boiling organic solvent and dispersed by emulsification in an aqueous hydrophilic colloid solution as the organic solvent solution.

Furthermore, when the compound(s) is(are) added to a processing solution, the compound(s) is(are) generally added as a solution in water, an alkai, or an organic solvent but as the case may be, the compound may be directly added to the processing solution as a powder thereof.

It is known to add a compound of formula (II) described above to a bleach bath or a blix bath but the manner of using the compound of formula (II) as in the present invention has not been known and furthermore, it is preferred to incorporate the compound in a color photographic material since various processing systems can be applied to the color photographic materials without the need of changing processing solutions to incorporate the compound(s) of the present invention in the various processing solutions.

The silver halide color photographic material of this invention contains a phenolic cyan dye-forming coupler having an arylureido group at the 2-position and a carbon-amido group at the 5-position in the silver halide emulsion as described above, and the cyan dye-forming coupler is preferably represented by formula (IV);

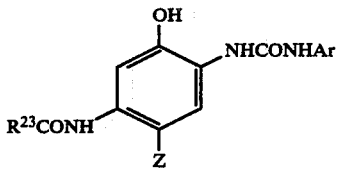

(IV)

wherein $R^{23}$ represents an aliphatic group, an aromatic group, or a heterocyclic group; Ar represents a substituted or unsubstituted aryl group; and Z represents a hydrogen atom or a group capable of releasing by a coupling reaction with the oxidation product of an aromatic primary amine developing agent.

In this case, the aliphatic group is an aliphatic hydrocarbon group (and so forth), includes a straight chain, branched, or cyclic alkyl group, alkenyl group, or alkynyl group, and may be substituted or unsubstituted.

The aromatic group is a substituted or unsubstituted aryl group and may form a condensed ring.

Also, the heterocyclic ring is a substituted or unsubstituted monocyclic or condensed heterocyclic ring group.

Then, the cyan dye-forming coupler shown by formula (IV) described above are explained in further detail.

$R^{23}$ in formula (IV) preferably represents an aliphatic group having from 1 to 36 carbon atoms, an aromatic group having from 6 to 36 carbon atoms, or a heterocyclic group having from 2 to 36 carbon atoms and is more preferably a tertiary alkyl group having from 4 to 36 carbon atoms or a group represented by formula (V) having 7 to 36 carbon atoms;

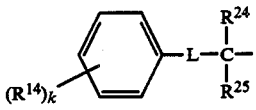

(V)

wherein $R^{24}$ and $R^{25}$ (which may be the same or different) each represents a hydrogen atom, an aliphatic group having from 1 to 30 carbon atoms, or an aromatic group having 6 to 30 carbon atoms; $R^{14}$ represents a monovalent group; L represents —O—, —S—, —SO—, or —$SO_2$—; and k represents an integer of 0 to 5. When k is plural, the plural $R^{14}$ groups may be the same or different.

In the preferred compounds shown by by formula (V) described above, $R^{24}$ and $R^{25}$ each represents a straight chain or branched alkyl group having from 1 to 18 carbon atoms; $R^{14}$ represents a halogen atom, an aliphatic group, an aliphatic oxy group, a carbonamido group, a sulfonamido group, a carboxy group, a sulfo group, a cyano group, a hydroxy group, a carbamoyl group, a sulfamoyl group, an aliphatic oxycarbonyl group, or an aromatic sulfonyl group; L represents —O—; and k is an integer of 1 to 3. Also, the carbon atom number of $R^{14}$ is preferably from 0 to 30.

In formula (IV) described above, Ar represents a substituted or unsubstituted aryl group, which may be condensed. Specific examples of the substituent for Ar are a halogen atom, a cyano group, a nitro group, a trifluoro-methyl group, —$COOR^{15}$, —$COR^{15}$, —$SO_2OR^{15}$, —$NHCOR^{15}$,

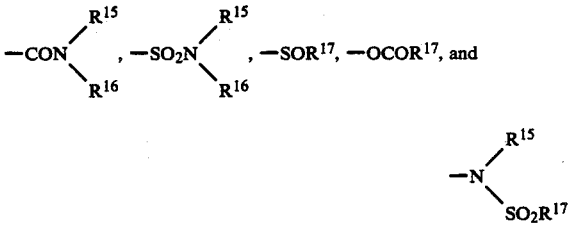

wherein $R^{15}$ and $R^{16}$ (which may be the same or different) each represents a hydrogen atom, an aliphatic group, an aromatic group, or a heterocyclic group, and $R^{17}$ represents an aliphatic group, an aromatic group, or a heterocyclic group. Ar from has 6 to 30 carbon atoms, and is preferably a phenyl group having a substituent as described above.

Z in formula (IV) described above represents a hydrogen atom or a coupling releasable group (including a coupling releasable atom).

Specific examples of the coupling releasable group are a halogen atom, —$OR^{18}$, —$SR^{18}$,

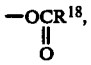

—$NHCOR^{18}$, —$NHSR^{18}$,

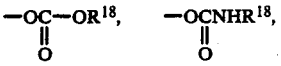

an aromatic azo group having 6 to 30 carbon atoms, a heterocyclic group having 1 to 30 carbon atoms and (e.g., succinic acid imido group, phthalimido group, hydantinyl group, pyrazolyl group, 2-benzotriazolyl group, etc.,) bonded to the coupling active position of the coupler with a nitrogen atom, etc., wherein, $R^{18}$ represents an aliphatic group having from 1 to 30 carbon atoms, an aromatic group having from 6 to 30 carbon atoms, or a heterocyclic group having from 2 to 30 carbon atoms.

The aliphatic group in this invention may be a saturated or unsaturated, substituted or usubstituted, and straight chain, branched, or cyclic aliphatic group. Specific examples thereof are a methyl group, an ethyl group, a butyl group, a cyclohexyl group, an allyl group, a propagyl group, a methoxyethyl group, a n-dicyl group, a n-dodecyl group, a n-hexadecyl group, a trifluoromethyl group, a heptafluoropropyl group, a dodecyloxypropyl group, a 2,4-di-tert-amylphenoxypropyl group, a 2,4-di-tert-amyl-phenoxybutyl group, etc.

The aromatic group may be a substituted or unsubstituted aromatic group and specific examples thereof are a phenyl group, a tolyl group, a 2-tetradecyloxyphenyl group, a pentafluorophenyl group, a 2-chloro-5-dodecyloxycarbonyl-phenyl group, a 4-chlorophenyl group, a 4-cyanophenyl group, a 4-hydroxyphenyl group, etc.

Also, the heterocyclic group may be substituted or unsubstituted and specific examples thereof are a 2-pyridyl group, a 4-pyridyl group, a 2-furyl group, a 4-thienyl group, a quinolyl group, etc.

Preferred examples of Z in formula (IV) are a hydrogen atom, a halogen atom, an alepthalic oxy group having from 1 to 30 carbon atoms (e.g., a methoxy group, a 2-methanesulfonamidoethoxy group, a 3-carboxy propyloxy group, a 2-carboxymethylethoxy group, a 2-methoxyethoxy group, a 2-methoxyethylcarbamoylmethoxy group, etc.), an aromatic oxy group (e.g., a phenoxy group, a 4-chlorophenoxy group, a 4-methoxyphenoxy group, a 4-tertoctylphenoxy group, a 4-carboxyphenoxy group, etc.), a heteroxyclic thio group (e.g., a 5-phenyl-1,2,3,4-tetrazolyl-1-thio group, a 5-ethyl-1,2,3,4-tetrazolyl-1thio group, etc.), and an aromatic azo group (e.g, a 4-dimethylaminophenylazo group, a 4-acetamidophenylazo group, a 1-naphthylazo group, a 2-ethoxycarbonylphenylazo group, a 2-methoxycarbonyl-4,5-dimethoxyphenylazo group, etc.) and a hydrogen atom and an aromatic oxy group are particularly preferred as Z.

Preferred examples of $R^{23}$ in formula (IV) are 1-(2,4-di-tert-amylphenoxy)amyl group, a 1-(2,4-di-tertamylphenoxy)heptyl group, a t-butyl group, etc.

Particularly preferred examples of Ar in formula (IV) are a 4-cyanophenyl group, a 4-alkylsulfonylphenyl group (e.g., a 4-methanesulfonamidophenyl group, a 4-propan-sulfonamidophenyl group, a 4-butanesulfonamido group, etc.) and a halogen-substituted phenyl group (e.g., a 4-fluorophenyl group, a 4-chlorophenyl group, a 3,4-dichlorophenyl group, a 2,4,5-trichlorophenyl group, etc.), and a 4-cyanophenyl group and a 4-butanesulfonyl group are particularly preferred.

Also, the cyan dye-forming coupler shown by formula (IV) may form a dimer or higher oligomer or a polymer bonded with each other through a di- or more valent group. In this case, the carbon atom number of each substitutent may be outside the above-described carbon atom number range.

Specific examples of the coupler represented by formula (IV) described above are illustrated below.

(IV-1)

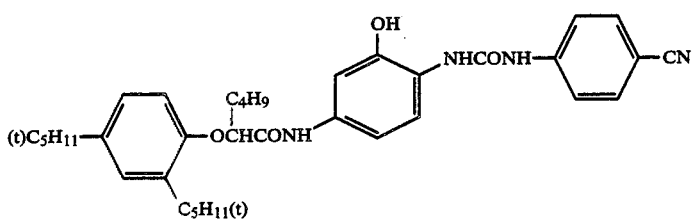

(IV-2)

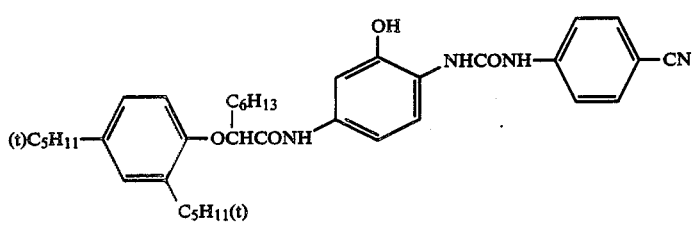

(IV-3)

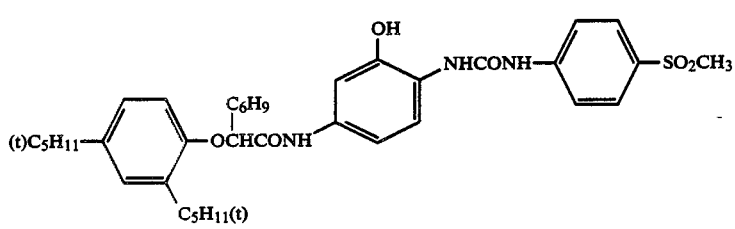

(IV-4)

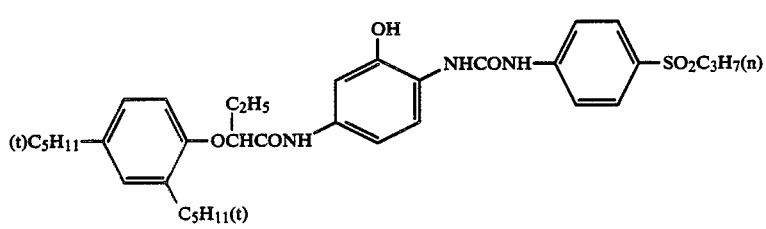

-continued
(IV-5)
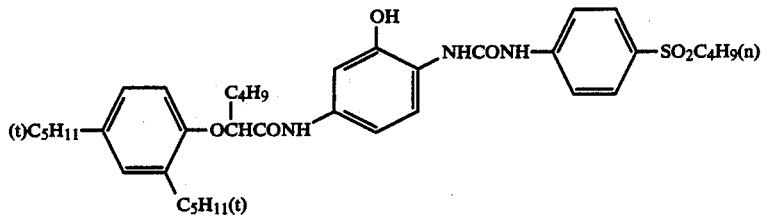
(IV-6)
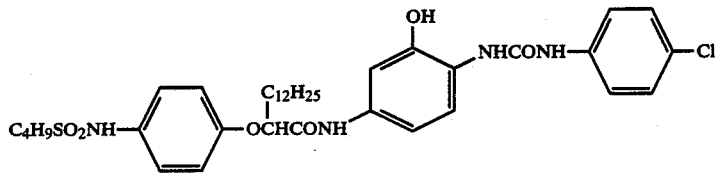
(IV-7)
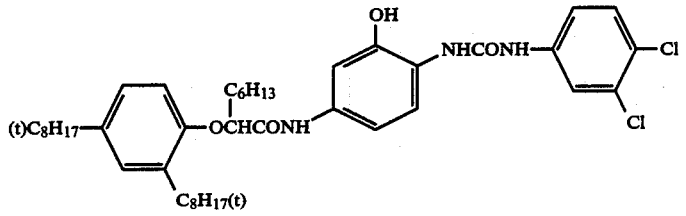
(IV-8)
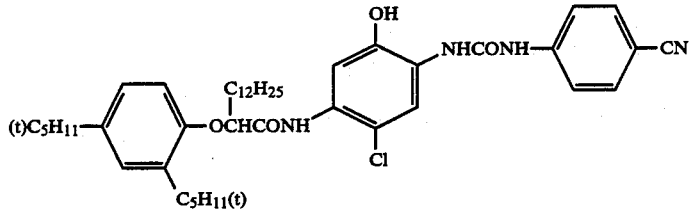
(IV-9)
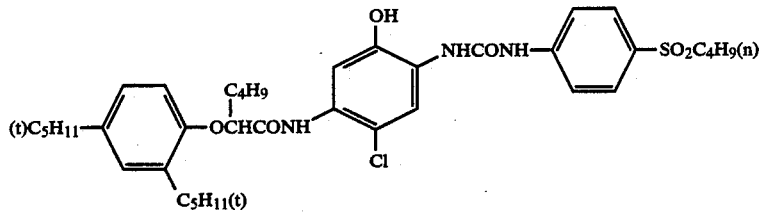
(IV-10)
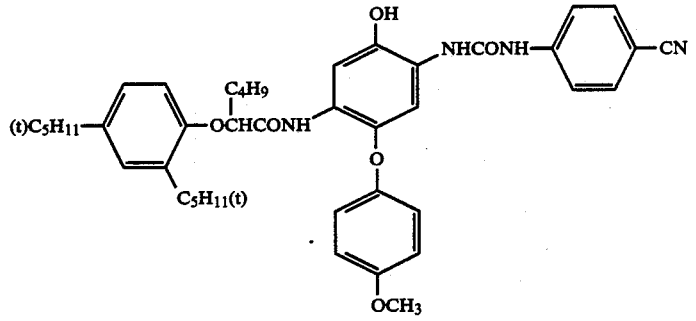

-continued
(IV-11)
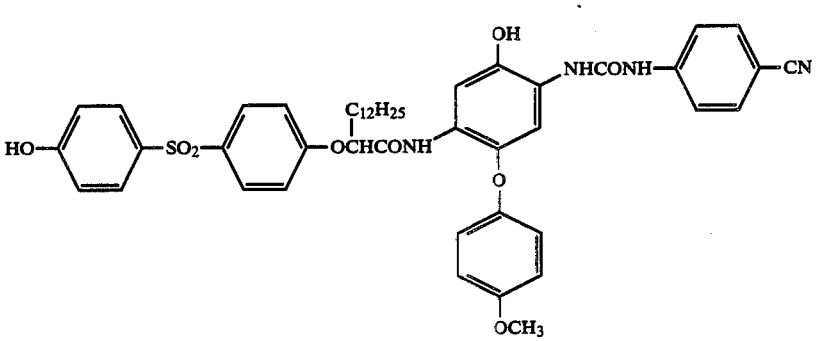
(IV-12)
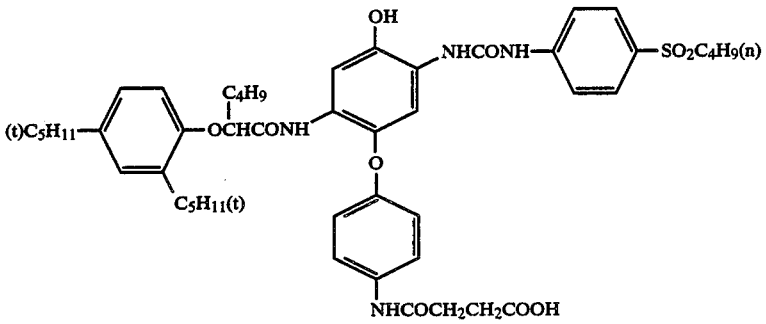
(IV-13)
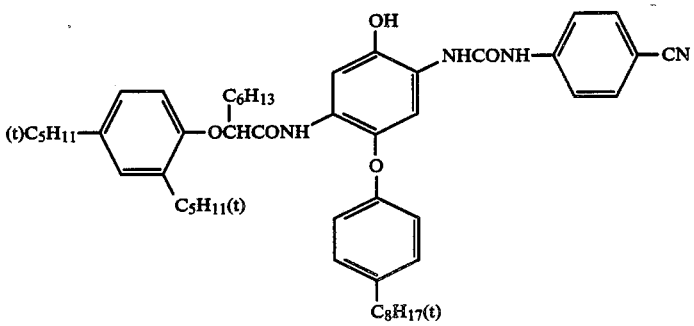
(IV-14)
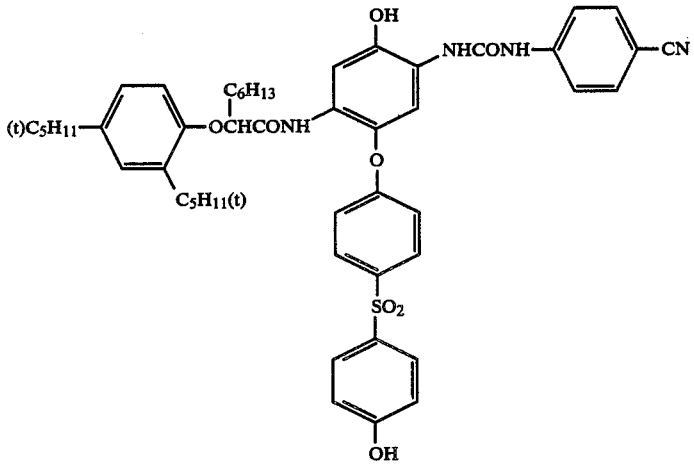

-continued
(IV-15)
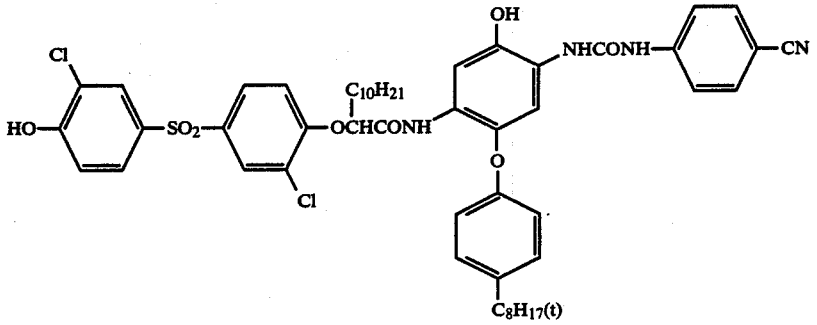
(IV-16)
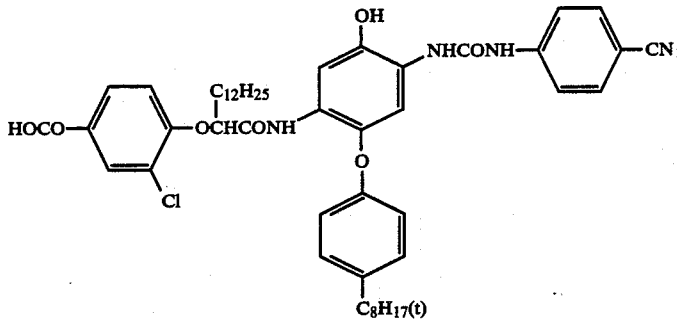
(IV-17)
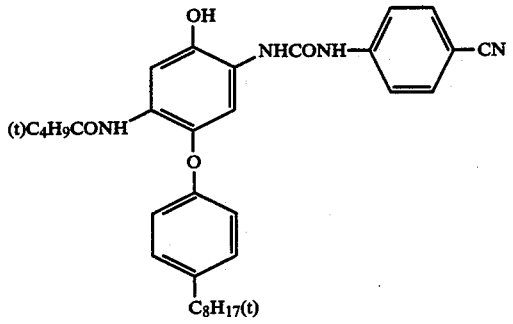
(IV-18)
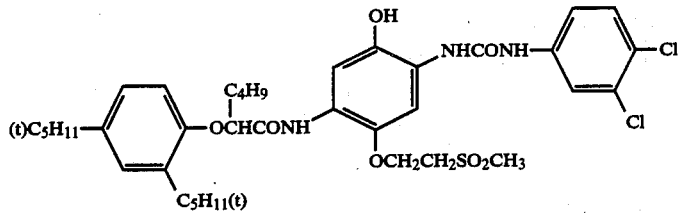
(IV-19)
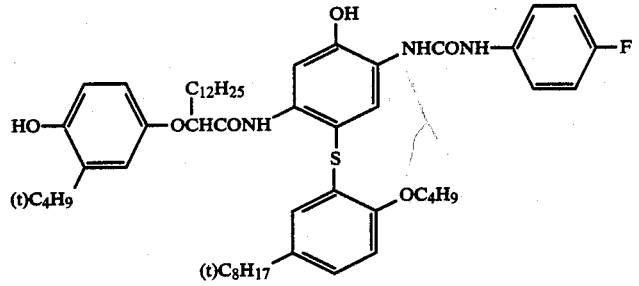
The couplers represented by formula (IV) for use in this invention can be synthesized according to the methods described in e.g., Japanese Patent Publication No. 9939/83, Japanese Patent Application (OPI) Nos. 35731/85, 49336/85, etc.
The addition amount of the coupler is generally from 0.05 to 1.0 g/m$^2$, preferably from 0.1 to 0.7 g/m$^2$, and more preferably from 0.2 to 0.5 g/m$^2$.

Furthermore, cyan couplers other than those of the present invention can be used together with the cyan couplers described above.

It is preferred that these cyan couplers for use in this invention are incorporated in red-sensitive silver halide emulsion layer group and when the red-sensitive emulsion layer is composed of two or more layers, it is preferred that four-equivalent cyan couplers are mainly used for a low-speed emulsion layer, an intermediate speed emulsion layer, and an interlayer (a light-insensitive layer disposed between the high-speed emulsion layer and the low-speed emulsion layer) and two-equivalent cyan couplers mainly for the high-speed emulsion layer. In the case of using four-equivalent couplers, it is preferred that two or kinds of the cyan couplers in this invention are used.

In a preferred embodiment of the silver halide color photographic materials of this invention, the color photographic material has at least one red-sensitive emulsion layer, at least one green-sensitive emulsion layer, and at least one blue-sensitive emulsion layer on a support and at least one of the emulsion layers contains a silver halide emulsions composed of core/shell type silver halide grains.

In a preferred embodiment of the above-described silver halide emulsion, the core of the core/shell type silver halide grains is substantially composed of silver iodobromide containing at least 10 mol%, more preferably at least 20 mol%, of silver iodide, and the shell covering the core is substantially composed of silver bromide or silver iodobromide having a silver iodide content of at most 5 mol%.

The core of the silver halide grains may uniformly contain silver iodide or has a structure composed of many phases having different silver iodide content. In the latter case, the means silver iodide content of the core is preferably at least 10 mol%, and more preferably at least 20 mol%. Also, the terminology "substantially composed of silver iodobromide" used herein means that the subject is mainly composed of silver iodobromide but may contain an other silver halide component up to about 1 mol%.

In a more preferred embodiment of the core/shell type silver halide grains for use in this invention, the silver halide grains have a structure of showing two diffraction maximums, i.e., one diffraction peak corresponding to the core portion and one diffraction peak corresponding to the shell portion, and one small diffraction minimum between the peaks when a diffraction intensity to diffraction angle curve at the (220) plane of the silver halide is obtained using the K line of Cu in the range of 38° to 42° as the diffraction angle (2 ).

For the silver halide emulsions for use in this invention, there is fundamentally no restriction on the grain size distribution but a mono-dispersed silver halide emulsion is more preferred. The terminology "mono-dispersed" means that at least 95% by weight or number of silver halide grains in the emulsion have grain sizes within ±40% of the mean grain size. Also, there is no particular restriction about the crystal habit of the silver halide grains for use in this invention, but regular crystals are preferred over twinned crystals.

In other preferred embodiment of the core/shell type silver halide grains, the relative standard deviation of the silver iodide content of each silver halide grain in the silver iodobromide emulsion is preferably less than 20%, and more preferably less than 12%. The silver iodide content of each silver iodobromide grain can be measured by analyzing the composition each grain one by one using, for example, an X-ray micro analyzer. The terminology "relative standard deviation of the silver iodide content of each grain" is the value multiplying by 100 the value of the standard deviation of silver iodide contents at the measurement of the silver iodide content of 100 silver iodobromide grains divided by the mean silver iodide content.

The core/shell type silver iodobromide grain of the silver halide emulsion for use in this invention can be formed by first forming silver iodobromide grains as the core and then covering the core with silver iodobromide or silver bromide.

For making uniform the silver iodide content in each silver halide grain, it is important to make uniform the sizes and the crystal habit of the silver iodobromide grains which become the core and the distribution of the silver iodide content among the grains which becomes the core as well as possible. For the purpose, an aqueous solution of silver nitrate and an aqueous solution of a mixture of an alkali metal iodide and an alkali metal bromide can be added to an aqueous protective colloid solution by a double jet method.

In particular, from the viewpoint of narrowing the distribution of silver iodide content among silver halide grains, it is important that the pAg of the system during the addition of the aforesaid solutions is kept constant in the range from 7.0 to 10.0, and more preferably from 8.0 to 9.0. Furthermore, it is preferred that the supersaturation degree of the solutions during the addition thereof is higher and a method of adding the aqueous solutions while increasing the concentrations thereof so that the growing speed of crystals becomes from 30 to 100% of the crystal growing speed as described, for example, in U.S Pat. No. 4,242,445, is effective. Also, it is preferred that an appropriate amount of a silver halide solvent such as ammonia, a thiocyanate, a thioether compound, etc., exists at the addition of the solutions.

For forming the silver iodobromide emulsion grains for use in this invention, it is necessary to cover the core formed by the aforesaid method with silver bromide or silver iodobromide as uniformly as possible. For this purpose, an aqueous solution of silver nitrate and an aqueous solution of alkali halides are added to an aqueous emulsion containing the core silver halide grains at a given pAg of from 6.0 to 10.0.

For performing particularly uniform coverage on the core, it is preferred to perform the additions of the aforesaid solutions a relatively high supersaturation degree so that the growing speed of the crystals become 30 to 100% of the critical growing speed of the crystals. By the method, a silver halide emulsion having a narrow distribution of silver ioddie content among silver iodobromide grains is obtained.

In this invention, the silver halide grains may be formed or physically ripened in the presence of a cadmium salt, a zinc salt, a lead salt, a thalium salt, an iridium salt or a complex salt thereof, a rhodium salt or a complex salt thereof, an iron salt or a comlex salt thereof, etc.

One of the features of the preferred embodiment of this invention is that the silver iodide content in the core portion of the core/shell type silver halide grains is at least 5 mol% and in this invention, it is preferred that the silver iodide content of the whole silver halide grain is from 5.0 to 25 mol%.

Next, the compounds shown by formula (III) described above for use in this invention are explained in more detail.

In formula (III), Q represents a heterocyclic group bonded directly or indirectly to $—SO_3M^2$, $—COOM^2$, —OH or $—NR^{21}R^{22}$, as described hereinbefore. Specific examples of the heterocyclic group represented by Q are an oxazole ring, a thiazole ring, an imidazole ring, a selenazole ring, a triazole ring, a tetrazole ring, a thiadiazole ring, an oxadiazole ring, a pentazole ring, a pyrimidine ring, a thiadia ring, a triazine ring, a thiadiazine ring, etc., or a heterocyclic ring condensed to other carbocyclic ring or heterocyclic ring, such as a benzothiazole ring, a benzotriazole ring, a benzimidazole ring, a benzoxazole ring, a benzoselenazole ring, a naphthoxazole ring, a triazaindolidine ring, a diazaindolidine ring, a tetraazaindolidine ring, etc.

Particularly preferred examples of the mercaptoheterocyclic compounds represented by formula (III) described above are those represented by formula (VI) or (VII) shown below.

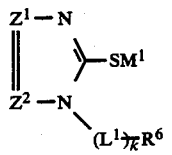
(VI)

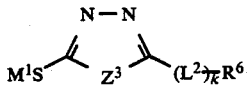
(VII)

In formula (VI) above, $Z^1$ and $Z^2$ each represents a nitrogen atom or $C-R^7$ (wherein $R^7$ represents a hydrogen atom, a substituted on unsubstituted alkyl group, or a substituted or unsubstituted aryl group); $R^6$ represents an organic group substituted by at least one of $—SO_3M^2$, $—COOM^2$, —OH, and $—NR^{21}R^{22}$, $R^6$ preferably represents an alkyl group having from 1 to 20 carbon atoms (e.g., a methyl group, an ethyl group, a propyl group, a hexyl group, a dodecyl group, an octadecyl group, etc.) or an aryl group having from 6 to 20 carbon atoms (e.g., a phenyl group, a naphthyl group, etc.) substituted by the above-mentioned groups; $L^1$ represents a linkage group selected from —S—, —O—, $$—\overset{|}{N}—,$$

—CO—, —SO—, and $—SO_2—$; and k represents 0 or 1. $M^1$, $M^2$, $R^{21}$, and $R^{22}$ have the same significance as defined above in regard to general formula [III].

The alkyl group or aryl group described above may have a substituent such as a halogen atom (e.g., fluorine, chlorine, bromine, etc.), an alkoxy group (e.g., a methoxy group, a methoxyethoxy group, etc.), an aryloxy group (e.g., a phenoxy group, etc.), an alkyl group (when $R^{22}$ is an aryl group), an aryl group (when $R^{22}$ is an alkyl group), an amido group (e.g., an acetamido group, a benzoylamino group, etc), a carbamoyl group (e.g., an unsubstituted carbamoyl group, a phenylcabamoyl group, a methylcarbamoyl group, etc.), a sulfonamido group (e.g., a methanesulfonamido group, a phenylsulfonamido group, etc.), a sulfamoyl group (e.g., an unsubstituted sulfamoyl group, a methylsulfamoyl group, a phenylsulfamoyl group, etc.), a sulfonyl group (e.g., a methylsulfonyl group, a phenylsulfonyl group, etc.), a sulfinyl group (e.g., a methylsulfonyl group, a phenylsulfinyl group, etc.), a cyano group, an alkoxycarbonyl group (e.g., a methoxycarbonyl group, etc.), an aryloxycarbonyl group (e.g., a phenoxycarbonyl group, etc.), a nitro group, etc.

When the organic group represented by $R^6$ has two or more substituents, $—SO_3M^2$, $—COOM^2$, —OH, and $—NR^{21}R^{22}$, these substituents may be same or different.

In formula (VII), Z3 represents a sulfur atom, an oxygen atom, or $$—\underset{R^8}{\overset{|}{N}}—$$

(wherein $R^8$ represents a hydrogen atom, a substituted or unsubstituted alkyl group, or a substituted or unsubstituted aryl group); $L^2$ represents $—CONR^9—$, $—NR^9CO—$, $—SO_2NR^9$, $—NR^9SO2—$, —OCO—, —COO—, —S—, $—NR^9—$, —CO—, —SO—, —OCOO—, $—NR^9CONR^{10}—$, $—OCONR^9—$, or $—NR^9SO_2NR^{10}$ (wherein $R^9$ and $R^{10}$ each represents a hydrogen atom, a substituted or unsubstituted alkyl group, or a substituted or unsubstituted aryl group); and $R^6$, $M^2$, and k have the same significance as described in regard to formula (VI).

Furthermore, as the substituents for the alkyl group and the aryl group represented by $R^7$, $R^8$, $R^9$, and $R^{10}$ described above, the substituents can be the same as those described above as those for $R^6$.

In the above formulae (VI) and (VII), $R^6$ is particularly preferably $—SO_3M^2$ or $—COOM^2$.

Specific examples of the compounds represented by formula (III) described above are illustrated below.

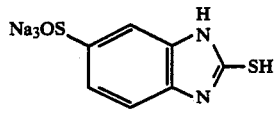
(III)-(1)

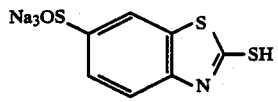
(III)-(2)

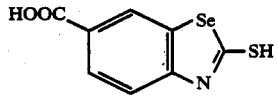
(III)-(3)

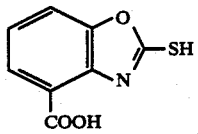
(III)-(4)

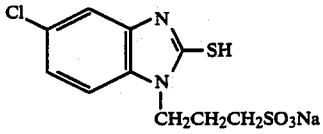
(III)-(5)

-continued
(III)-(6)
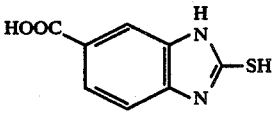
(III)-(7)
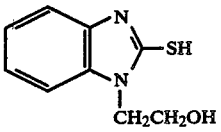
(III)-(8)
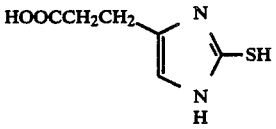
(III)-(9)
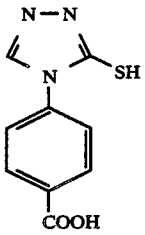
(III)-(10)
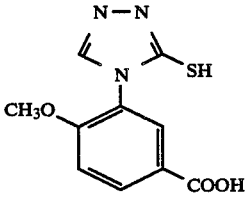
(III)-(11)
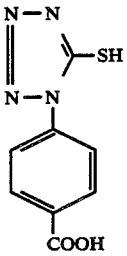
(III)-(12)
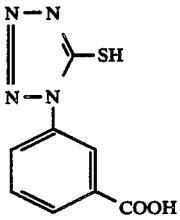
(III)-(13)
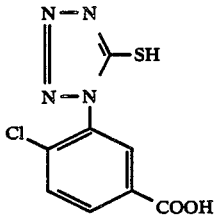
-continued
(III)-(14)
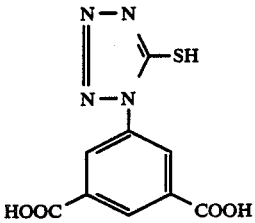
(III)-(15)
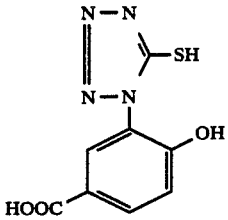
(III)-(16)
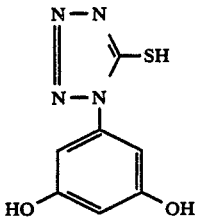
(III)-(17)
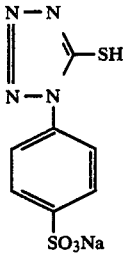
(III)-(18)
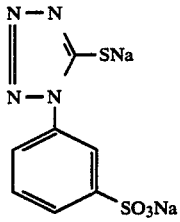
(III)-(19)
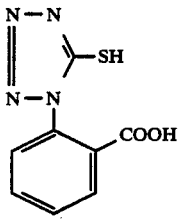
(III)-(20)
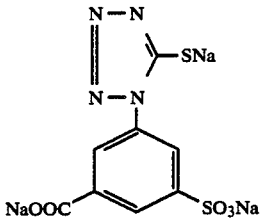

-continued
(III)-(21)
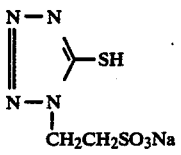
(III)-(22)
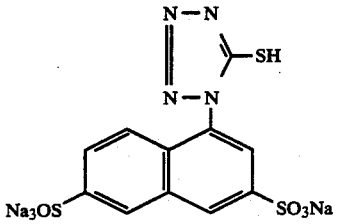
(III)-(23)
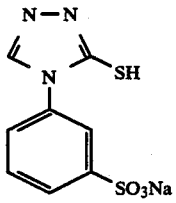
(III)-(24)
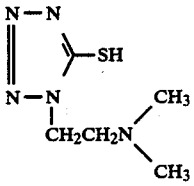
(III)-(25)
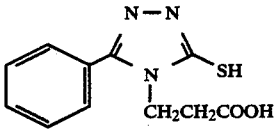
(III)-(26)
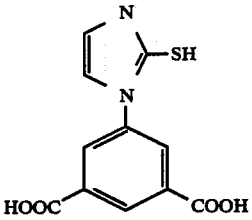
(III)-(27)
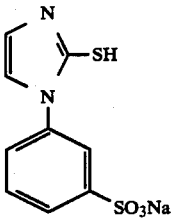
(III)-(28)
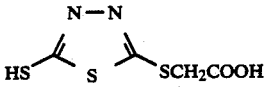
-continued
(III)-(29)
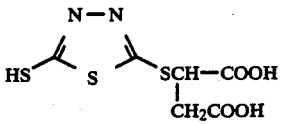
(III)-(30)
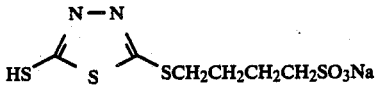
(III)-(31)
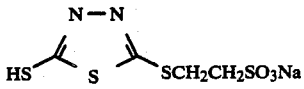
(III)-(32)
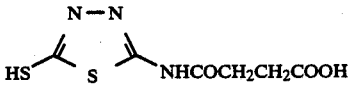
(III)-(33)
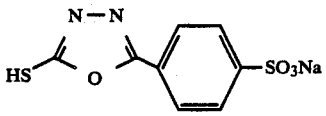
(III)-(34)
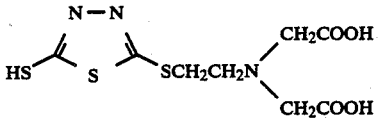
(III)-(35)
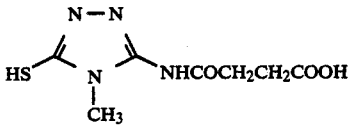
(III)-(36)
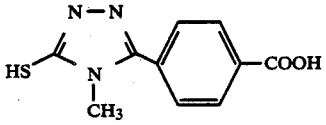
(III)-(37)
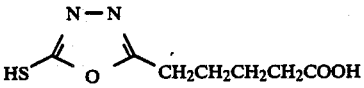
(III)-(38)
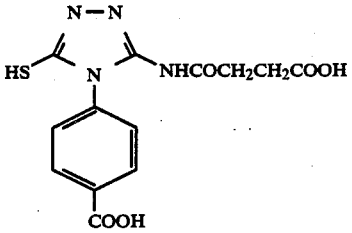
(III)-(39)
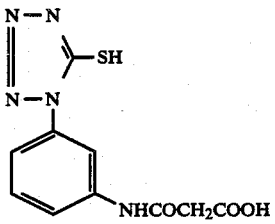
The compounds of formula (III) described above, which are used in this invention, are known and can be synthesized by the methods described in the following literature, for examples, U.S. Pat. Nos. 2,585,388, 2,541,924, Japanese Patent Publication Nos. 21842/67, 50169/78, British Patent No. 1,275,701; D. A. Berges et al, *Journal of Heterocyclic Chemistry*, Vol. 15, No. 981(1978), "The Chemistry of Heterocyclic Chemistry" Imidazole and Derivatives, part I, pages 336–339; *Chemical Abstract*, Vol. 58, No. 7921/1963), page 294; E. Hoggarth, *Journal of Chemical Society*, 1160–1167(1949); S. R. Saulder and W. Karo, *Organic Factional Group Preparation*, 312–315(1968), published by Academic Press; M. Chamdon et al, *Bulletin de la Societe Chimique de France*, 723(1954); D. A. Shirley and D. W. Alley, *Journal of American Chemical Society*, Vol. 79, 4922(1954); A. Wohl and W. Marchwald, *Ber.*, Vol. 22, 268(1889); *Journal of the Americal Chemical Society*, Vol. 44, 1502–1510(1922); U.S. Pat. No. 3,017,270, British Patent No. 940,169, Japanese Patent Publication No. 8334/74, Japanese Patent Application (OPI) No. 59463/80; *Advanced in Heterocyclic Chemistry*, Vol. 9, 165–1209(1968); West German Patent No. 2,716,707; *The Chemistry of Heterocyclic Compounds Imidazole and Derivatives*, Vol. 1, page 384; *Organic Synthesis*, IV, 569(1963); *Ber.*, Vol. 9, 465(1976); *Journal of the Americal Chemical Society*, Vol. 45, 2390(1923); Japanese Patent Application (OPI) Nos. 89034/75, 28426/78, 21007/80, and Japanese Patent Publication No. 29496/65.

The compound shown by general formula (III) described above is incorporated in a silver halide emulsion layer or a hydrophilic colloid layer (e.g., an interlayer, a surface protective layer, a yellow fitter layer, an antihalation layer, etc.,), of the silver halide color photographic material of this invention but it is preferred that the compound exists in the silver halide emulsion layer or a layer adjacent to the emulsion layer.

The addition amount of the compound represented by formula (III) is preferably from $1\times10^{-5}$ to $1\times10^{-1}$ g/m$^2$, more preferably from $1\times10^{-4}$ to $4\times10^{-3}$ g/m$^2$, and particularly preferably from $5\times10^{-4}$ to $2\times10^{-3}$ g/m$^2$.

A color developer which is used for developing the color photographic materials of this invention is an alkaline aqueous solution, preferably an aromatic primary amino color developing agent as the main component. As the color developing agent, aminophenolic compounds are useful, but p-phenylenediamino compounds are preferably used. Specific examples of such compounds are 3-methyl-4-amino-N,N-diethyl-aniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-βmethoxyethylaniline and the sulfates, hydrochlorides, phosphates, p-toluenesulfonates, tetraphenylborates, p-(t-octyl)benzenesulfonates of them. In the above-described compounds, 3-methyl-4-amino-N-ethyl-N-β-hydroxyethylaniline salts and 3-methyl-4-amino-N-ethyl-N-β-methanesulfonamidoethylaniline salts are particularly preferred.

These diamines are generally stable in the salt states as compared to the free states, and hence are preferably used as salts thereof.

Aminophenol derivatives which are also used as a color developing agent include o-aminophenol, p-aminophenol aminophenol, 4-amino-2-methylphenol, 2-amino-3-methylphenol, 2-oxy-3-amino-1,4-dimethylbenzene, etc.

Other color developing agents described in L. F. A. Mason, *Photographic Processing Chemistry*, pages 226–229, published by Focal Press, U.S. Pat. Nos. 2,193,015, and 2,592,364, Japanese Patent Application (OPI) No. 64933/73, etc., can be also used in this invention.

If desired, a combination of two or more color developing agents described above can be used.

The color developers for use in this invention can contain pH buffers such as carbonates, borates, or phosphates of an alkali metal; development inhibitors or antifoggants such as bromides, iodide, benzimidazoles, benzothiazoles, mercapto compounds, etc.; preservatives such as hydroxylamine, triethanolamine, the compounds described in West German Patent Application (OLS) No. 2,622,950, sulfites, hydrogensulfites, etc.; organic solvents such as diethylene glycol, etc.; development accelerators such as benzyl alcohol, polyethylene glycol, quaternary ammonium salts, amines, thiocyanates, 3,6-thiaoctane-1,8-diol, etc.; dye-forming couplers; competing couplers; nucleating agents such as sodium boron hydride, etc.; auxiliary developing agents such as 1-phenyl-3pyrazolidone, etc.; and chelating agents such as aminopolycarboxylic acids (e.g., ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, the compounds described in Japanese Patent Application (OPI) No. 195845/83, etc.,), 1-hydroxyethylidene-1,1'-diphopshonic acid, the organic phosphonic acids described in *Research Disclosure*, 18170 (May 1979), aminophosphonic acids (e.g., aminotris(ethylenephosphonic acid), ethylenediamine-N,N,N',N'-tetramethylenephosphonic acid, etc.,), and the phosphonocarboxylic acids described in Japanese Patent Application (OPI) Nos. 102726/77, 42730/78, 121127/79, 4024/80, 4025/80, 12641/80, 65955/80, 65956/80, and *Research Disclosure*, No. 18170 (May 1979).

In this invention, a color developing agent is used in a concentration of from about 0.1 g to about 30 g, and preferably from about 1 g to about 15 g, per liter of a color developer. Also, the pH of the color developer is usually higher than 7, and preferably is from about 9 to about 13. Furthermore, by using a replenisher for the color developer having controlled concentrations that is a reduced halide content and an increased color developer content, the used amount of the replenisher can be reduced.

When the invention is applied to a reversal color photographic material, the color development is usually performed after black and white development. For the black and white developer, known black and white developers such as dihydroxybenzenes (e.g., hydroquinone, hydroquinone monosulfonate, etc.), 3-pyrazolidones (e.g., 1-phenyl-3-pyrazolidone, etc.), aminophenols (e.g., N-methyl-p-aminophenol, etc.), etc., can be used solely or a combination thereof.

The color photographic materials of this invention are bleached after color development and in this case, it is preferred that the color photographic materials are bleached through processing with a stop bath after color development. Also, the bleach process may be performed simultaneously with a fix process by a one bath blix (bleach-fix) or may be performed separately from the fix process. Furthermore, for quickening the photographic processing, blixing may be performed after bleaching.

As the bleaching agent which is used for the bleach process or the blix process, there are, for example, compounds (e.g., ferricyamides) of a multi-valent metal such as iron (III), cobalt (III), chromium (VI), copper (II), etc.; peracids; nitroso compounds; dichromates; organic complex salts (e.g., complex salts of ethylenediaminetetraacetic acid, dithylenetriaminepentaacetic acid, aminopolyphosphonic acid, phosphonocarboxylic acid, and other organic phosphonic acids) of iron (III) or cobalt (III); organic acids such as citric acid, tartaric acid, malic acid, etc.; persulfates, hydrogen peroxide; permanganates, etc. In these compounds, organic complex salts of iron (III) and persulfates are preferred from the viewpoint of quick processing and the prevention of environmental polution. In particular, the use of an aminopolycarboxylate is preferred. Examples of aminopolycarboxylic acid and aminopolyphosphonc acid useful for forming the organic complex salts of iron (III), which are preferably used as a bleaching agent in this invention, are ethylenediaminetetraacetic acid,
diethylenetriaminepetaacetic acid,
diethylenediamine-N-(β-oxyethyl)-N,N',N'-triacetic acid
1,2-diaminopropanetetraacetic acid,
triethylenetetraminehexaacetic acid,
propylenediaminetetraacetic acid,
nitrilotriacetic acid,
nitrilotripropionic acid,
cyclohexanediaminetetraacetic acid,
1,3-diamino-2-propanoltetraacetic acid,
methyliminodiacetic acid,
iminodiacetic acid,
hydroxyliminodiacetic acid,
dihydroxyethylglycine ethyl ether diaminetetraacetic acid,
glycol ether diaminetetraacetic acid,
ethylenediaminetetrapropionic acid,
ethylenediaminedipropionic acid,
phenylenediaminetetraacetic acid,
2-phosphonobutane-1,2,4-triacetic acid,
1,3-daminopropanol-N,N,N',N'-tetramethylenephosphonic acid,
ethylenediamine-N,N,N',N'-tetramethylenephosphonic acid,
1,3-propylenediamine-N,N,N',N'-tetramethylenephosphonic acid,
1,-hydroxyethylene-1,1'-diphosphonic acid, etc.

In these compounds, the iron(III) complex salts of ethylenediaminetetraacetic acid, diethylenetriaminepentaacetic acid, cyclohexanediaminetetraacetic acid, 1,2-diaminopropanetetraacetic acid, and methyliminodiacetic acid are preferred from the viewpoint of high bleaching power. The iron(III) complex salts of ethylenediaminetetraacetic acid and diethylenetriaminepentaacetic acid are particularly preferred.

In this invention, the iron(III) complex salts may used singly or as a combination of two or more as the forms of the complex salts or may be formed as ferric ion complex salt(s) in a solution by reacting an iron(III) salt (e.g., ferric sulfate, ferric chloride, ferric nitrate, ferric ammonium sulfate, ferric phosphate, etc.) and a chelating agent (e.g, aminopolycarboxylic acid, aminopolyphosphonic acid, phosphonocarboxylic acid, etc.) in the solution. In the case of forming the complex salt in a solution, two or more kinds of ferric salts and/or chelating agents may be used. In both the cases of using the iron(III) complex salt(s) as the form of the complex salt(s) or forming the complex salt(s) in a solution, a chelating agent may be used in more than a stoichiometric amount.

The bleach liquid or blix liquid containing the above-described ferric ion complex may further contain ions of metal(s) other than iron, such as calcium, magnesium, aluminum, nickel, bismuth, zinc, tungsten, cobalt, copper, etc., a complex salt of the metal, or hydrogenperoxide.

Also, examples of the persulfate which can be used for bleach processing or blix processing in this invention are alkali metal persulfates such as potassium persulfate, sodium persulfate, etc., and ammonium persulfate.

It is preferred that the bleach liquid or blix liquid for use in this invention contains a rehalogenating agent such as a bromide (e.g., potassium bromide, sodium bromide, ammonium bromide, etc.,), a chloride (e.g., potassium chloride, sodium chloride, ammonium chloride, etc.,), and an iodide (e.g., ammonium iodide, etc.,). Also, if necessary, the bleach liquid or blix liquid may further contain a corrosion inhibitor such as an inorganic acid or an organic acid having a pH buffering capability, or the alkali metal salt or ammonium salt thereof, such as boric acid, borax, sodium metaborate, acetic acid, sodium acetate, sodium carbonate, potassium carbonate, phosphorus acid, phosphoric acid, sodium phosphate, citric acid, sodium citrate, tartaric acid, etc., or ammonium nitrate, guanidine, etc.

A proper amount of the bleaching agent is from 0.1 to 2 mols per liter of bleaching liquid. The pH range of the bleach liquid is preferably from 0.5 to 8.0 in the case of using a ferric ion complex salt as the bleaching agent and more particularly is preferably from 4.5 to 6.5, more preferably 5.0 to 6.0, particularly preferably for, 5.3 to 5.7 in the case of using the ferric ion complex salt of aminopolycarboxylic acid, aminopolyphosphoric acid, phosphonocarboxylic acid, or an organic phosphonic acid. Also, the pH range of the bleach liquid is preferably from 1 to 5 and the concentration of the bleaching agent is preferably from 0.1 to 2 mol/liter in the case of using a persulfate as the bleaching agent.

Examples of the fixing agent used for the fix or the blix in this invention include thiosulfates such as sodium thiosulfate ammonium thiosulfate, etc.; thiocyanates such as sodium thiocyanate, ammonium thiocyanate, etc.; thioether compounds such as ethylenebisthioglycolic acid, 3,6-dithia-1,8-octanediol, etc.; and water-soluble silver halide dissolving agents such as thioureas, etc. They may be used solely or as a mixture thereof. Furthermore, for the blix processing in this invention, a specific blix liquid composed of a combination of a fixing agent and a large amount of a halide such as potassium iodide, etc., as described in Japanese Patent Application (OPI) No. 155354/80 can also be used.

In the case of fix or blix processing, the concentration of the fixing agent is preferably from 0.2 to 4 mols/liter. Also, for blix processing, it is preferred that the concentration of the ferric ion complex salt is from 0.1 to 2 mols per liter of the blix liquid, and that the concentration of the fixing agent is from 0.2 to 4 mols/liter. Also, the pH range of the fix liquid or the blix liquid is preferably from 4.0 to 9.0, and more preferably from 5.0 to 8.0.

It is also preferred that the fix liquid or the blix liquid further contain a sulfite (e.g., sodium sulfite, potassium sulfite, ammonium sulfite, etc.), a hydrogensulfite, hydroxylamine, hydrazine, a hydrogensulfite addition product of an aldehyde compound (e.g., acetaldehyde sodium hydrogensulfite), etc., as a preservative. Furthermore, the fix liquid or the blix liquid may contain an optical whitening agent, a defoaming agent, a surface active agent, or an organic solvent such as polyvinylpyrrolidone, methanol, etc.

The bleach liquid, the blix liquid and/or the prebath therefor can, if desired, contain a bleach accelerator. Specific examples of the useful bleach accelerators are the compounds having a mercapto group or a disulfido group described in U.S. Pat. No. 3,893,858, West German Patents 1,290,812, 2,059,988, Japanese Patent Application (OPI) Nos. 32736/78, 57831/78, 37418/78, 65732/78, 72623/78, 95630/78, 95631/78, 104232/78, 124424/78, 141623/78, 28426/78, *Research Disclosure,* No. 17129 (1978, July), etc.; the thiazoline derivatives described in Japanese Patent Application (OPI) No. 140129/75; the thiourea dervatives described in Japanese Patent Publication No. 8506/70, Japanese Patent Application (OPI) Nos. 20842/77, 32735/78, U.S. Pat. No. 3,706,561, etc.; the iodides described in West German Patent No. 1,127,715, Japanese Patent Application (OPI) No. 16235/83, etc.; the polyethylene oxides described in West German Patent Nos. 966,410, 2,748,430, etc.; the polyamine compounds described in Japanese Patent Publication No. 8836/70, etc., the compounds described in Japanese Patent Application (OPI) Nos. 42434/74, 59644/74, 94927/78, 35727/79, 26506/80, 16394/83, etc.; and iodide ions and bormide ions. In these compounds, the compounds having a mercapto group or a disulfido group are preferred from the viewpoint of high bleaching accelerating effect and also the compounds described in U.S. Pat. No. 3,893,858 West German Patent No. 1,290,812, and Japanese Patent Application (OPI) No. 95630/78 are particularly preferred. Furthermore, the compounds described in U.S. Pat. No. 4,552,834 are preferably used in this invention. These bleaching accelerators may be incorporated in the color photographic materials of this invention.

After the fix step or the blix step, a processing step such as washing or stabilization is generally performed.

For the wash step and the stabilization step, various kinds of additives may be used for precipitation prevention and stabilization of wash water. For example, chelating agents such as inorganic phosphoric acids, aminopolycarboxylic acids, organic phosphonic acids, etc.; antibacterial agents or antifungal agents for preventing the generation of various bacterium, algae, and molds (e.g., the compounds described in *J. Antibact. Antifung. Agents,* Vol. 11, No. 5, 207–223(1983) and the compounds described in Hiroshi Horiguchi, *Bokin Bobai no Kagak (Antibacteria Antifungal Chemistry)*), metal salts such as magnesium salts, aluminum salts, bismuth salts, etc., alkali metal salts, ammonium salts, surface active agents for preventing the occurence of drying load and uneven drying, etc., may be used as the case may be. Furthermore, the compounds described in *Photographic Schience and Engineering,* Vol. 6, 344–359(1965) may be used for the wash step or the stabilization step.

The wash step is generally performed by a multistage countercurrent wash system using two or more wash tanks (e.g., 2 to 9 wash tanks) for saving wash water. Furthermore, in place of the wash step, a multistage countercurrent stabilization step as described in Japanese Patent Application (OPI) No. 8543/82 may be employed.

To the stabilization liquid are added various kinds of compounds for stabilizing images in addition to the aforesaid additive(s). For example, there are various kinds of buffers for controlling pH of films (e.g., to a value of from pH 3 to 9) (e.g., borates, metaborates, borax, phosphates, carbonates, potassium hydroxide, sodium hydroxide, aqueous ammonia, monocarboxylic acid, dicaboxylic acid, polycarboxylic acid, etc., as a combination thereof) and aldehydes such as formalin (i.e., an aqueous solution of formaldehyde). Also, other additives such as chelating agents (e.g., inorganic phosphoric acids, aminopolycarboxylic acids, organic phosphonic acids, aminopolyphosphonic acid, phosphonocarbonic acid, etc.), sterilizers, animolds (e.g., thiazole series, isothiazole series, halogenated phenol, sulfanylamide, benzotriazole, etc.), surface active agents, optical whitening agents, hardening agents, metal salts, etc., may be used. They may be used as a mixture of two or more of the same or different kinds of compounds.

Also, it is preferred to add various ammonium salts such as ammonium chloride, ammonium nitrate, ammonium sulfate, ammonium phosphate, ammonium sulfite, ammonium thiosulfate, etc., to the stabilization bath in this invention for improving the storability of color images.

When this invention is applied to color photographic materials for photographing, the (wash-stabilization) step after fix can be replaced with the aforesaid stabilization step and wash step (water saving processing). In this case, when two-equivalent magenta couplers are used, formalin in the stabilization bath may be omitted.

The wash procesing time and the stabilization processing time depends upon the kind of the color photographic materials to be processed and the processing conditions but is usually from 20 sec. to 10 min., and preferably from 20 sec. to 5 min.

Various processing liquids are used at 10° C. to 50° C. in this invention, typically at 33° C. to 38° C. However, in this invention, the processing temperature may be higher than the aforesaid temperature for shortening the processing time or may be lower than the aforesaid temperature for attaining improvement of the image quality and improvement of the stability of processing liquids. Also, for silver saving of color photographic materials, the process of using cobalt intensification or hydrogen peroxide intensification described in West German Patent No. 2,226,770 or U.S. Pat. No. 3,674,499 or the mono-bath development blix processing described in U.S. Pat. No. 3,023,511 can be performed.

Also, the processing time can be reduced to as short a time as possible in a range that avoides problems due to quickening of the processing.

The silver halide color photographic material of this invention may further contain a color developer or a precursor thereof for simplification and quickening of photographic processing therefor. In this case, as the component incorporated in the color photographic material, the precursor is preferred from the viewpoint of increasing the stability of the color photographic material.

Specific examples of the precursor for color developing agent are the indoaniline series compounds described in U.S. Pat. No. 3,342,597, etc., the Schiff base type compounds described in U.S. Pat. No. 3,342,599, *Research Disclosure,* No. 14850 (August 1976), ibid, No. 15159 (November 1976), etc., the aldol compounds described in Research Disclosure, No. 13924, the metal salt complexes described in Japanese Patent Application (OPI) No. 13528/78, etc, and the various salt type precursors described in Japanese Patent Application (OPI) Nos. 6235/81, 16133/81, 59232/81, 67842/81, 83734/81, 83735/81, 83736/81, 89735/81, 81837/81, 54430/81, 106241/81, 107236/81, 97531/82, 83565/81, etc.

The silver halide color photographic material of this invention may further contain a 1-phenyl-3pyrazolidone for accelerating the color development thereof. Specific examples of the pyrazolidone are described in Japanese Patent Application (OPI) Nos. 64339/81, 144547/82, 211147/82, 50532/83, 50533/83, 50534/83, 50535/83, 50536/83, 115438/83, etc.

Also, at continuous processing of color photographic materials, replenishers for processing liquids are used for preventing the deviation of the composition of each processing liquid, whereby constant finish can be obtained. The amount of each replenisher can be reduced to a half or less than half of a standard amount of replenisher for const reduction, etc.

Each processing tank for use in this invention may be, if desired, equipped with a heater, a temperature sensor, a liquid level sensor, a circulation pump, a filter, a floating lid, a squeezer, etc.

In this invention, a blix process is employed very generally in the case of applying this invention to color photographic papers or if appropriate in the case of applying this invention to color photographic materials for photographic use.

The couplers for use in this invention can be introduced in the color photographic materials by various dispersing methods such as a solid dispersion method, an alkali dispersion method, preferably a latex dispersion method, more preferably an oil-in-water dispersion method, etc.

In the oil-in-water dispersion method, the coupler is dissolved in a high-boiling organic solvent having a boiling point of at least 175° C. and/or a so-called auxiliary solvent having low boiling point, and then finely dispersed in water or an aqueous medium such as an aqueous gelatin solution in the existence of a surface active agent as the solution thereof. Examples of the high-boiling point organic solvent are described in U.S. Pat. No. 2,322,027, etc.

The formation of the dispersion may be accomplished with phase inversion. The auxiliary solvent may be removed or reduced by distillation, noodle washing, or ultrafiltration, before the dispersion of the coupler is coated.

Specific examples of the high-boiling point organic solvent which is used for dispersing the couplers in this invention include phthalic acid esters (e.g., dibutyl phthalate, dicyclohexyl phthalate, di-2-ethylhexyl phthalate, decyl phthalate, etc.), phosphoric acid esters or phophonic acid esters (e.g., triphenyl phosphate, tricresyl phosphate, 2-ethylhexyl-diphenyl phosphate, tricyclohexyl phosphate, tri-2-ethylhexyl phosphate, tridecyl phosphate, tributoxyethyl phosphate, trichloropropyl phosphate, etc.}benzoic acid esters (e.g., 2-ethylhexyl benzoate, dodecyl benzoate, 2-ethylhexyl-p-hydroxy benzoate, etc.), amides (e.g., diethyl-decaneamide, N-tetradecylpyrraolidone, etc.), alcohols or phenols (e.g., isosteraryl alcohol, 2,4-di-tert-amylphenol, etc.), aliphatic carboxylic acid esters (e.g., dioctyl azerate, glycerol tributyrate, isostearyl lactate, trioctyl citrate, etc.), aniline derivatives (e.g., N,N-dibutyl-2-butoxy-5-tert-octylaniline, etc.) hydrocarbond (e.g., paraffin, dodecylbenzene, diisopropylnaphthalene, etc.), etc.

In this invention, an organic solvent having low boiling point of at least about 30° C., and preferably from about 50° C. to about 160° C. can be used as auxiliary solvent as described above. Specific examples of the low-boiling organic solvent are ethyl acetate, butyl acetate, ethyl propionate, methyl ethyl ketone, cyclohexanone, 2-ethoxyethyl acetate, dimethyl-formamide, etc.

The steps and effects of the latex dispersion method and specific examples of latex for impregnation are described in U.S. Pat. No. 4,199,363, West German Patent Application (OLS) Nos. 2,541,274, 2,541,230, etc.

In an embodiment of this invention described hereinbefore, silver bromide silver iodobromide, silver iodochloro-bromide, or silver chlorobromide may be used for the silver halide emulsion layers of the color photographic materials of this invention. The preferred silver halide is silver iodobromide or silver iodochlorobromide each containing less than about 30 mol% silver iodide. Silver iodobromide containing from 2 mol% to 25 mol% is particularly preferred in this invention.

The silver halide grains in the silver halide emulsion for use in this invention may be so-called regular grains having regular crystal form such as cubic, octahedral, tetradecahedral, etc., irregular grains having irregular crystal forms such as spherical, etc., grains having crystal defects such as twinning, or a composite form thereof.

The silver halide may be a fine grain silver halide having a projected area diameter of less than about 0.1 micron or a large grain silver halide having a projected area diameter of up to about 10 microns. The silver halide emulsion for use in this invention may be a monodispersed emulsion having a narrow silver halide grain size distribution or a poly-dispersed emulsion having a wide grain size distribution.

The silver halide photographic emulsions for use in this invention can be prepared by the methods described in P. Glafkides, *Chimie et Physique Photographique,* Paul Montel, 1967; G. F. Duffin, *Photographic Emulsion Chemistry,* Focal press, 1966; V. L. Zelikman et al, *Making and Coating Photographic Emulsion,* Focal press, 1964, etc. That is, the photographic emulsions may be prepared by an acid method, a neutralization method, an ammonia method, etc. Also, as a method of reacting a soluble silver salt and a soluble halide, a single jet method, a double jet method, or a combination thereof may be used. A so-called reverse jet method for forming silver halide grains in the presence of excess silver ions can also be used.

As one of the double jet methods, the so-called controlled double jet method of keeping a constant pAg in a liquid phase used for forming silver halide can be used. According to this method, a silver halide emulsion containing silver halide grains having a regular crystal form and almost uniform grain size is obtained.

Two or more kinds of silver halide emulsions separately prepared may be used as a mixture thereof.

The silver halide emulsion containing the aforesaid regular silver halide grains can be obtained by controlling the pAg and pH of the system during the formation of the silver halide grains. Details of the method are described in *Photographic Science and Engineering,* Vol. 6, 159–165(1962), *Journal of Photographic Science,* Vol.

12, 242-251(1964), U.S. Pat. No. 3,655,394, British Patent No. 1,413,748, etc.

A mono-dispersed silver halide emulsion which contains typically silver halide grains having a mean grain size (diameter) of larger than about 0.1 micron, at least about 95% by weight of which is within ±40% of the mean grain size can be used in the present invention. A silver halide emulsion containing silver halide grains having a mean grain size of from about 0.25 to about 2 microns, at least about 95% by weight or number of which is within the range of ±20% of the mean grain size, can also be used in this invention. The production method for such a mono-dispersed silver halide emulsion is described in U.S. Pat. Nos. 3,574,628, 3,655,394, British Patent No. 1,413,748, Also, useful are the mono-dispersed silver halide emulsions as described in Japanese Patent Application (OPI) Nos. 8600/73, 39027/76, 83097/76, 137133/78, 48521/79, 99419/79, 37635/83, 49938/83, etc.

In this invention, by the use of a tabular grain silver halide emulsion for the color photographic materials of this invention, a improvement of sensitivity including the improvement of color sensitization effect by sensitizing dye(s), the improvement of the relation of sensitivity and graininess, the improvement of sharpness, the improvement of the progress of development, etc., can be attained.

The tabular silver halide grains are silver halide grains having an aspect ratio (diameter/thickness) of at least 5 (i.e., at least 5/1), and preferably from 5 to 8.

The "diameter" of a tabular silver halide grain is considered to be the diameter of a circle having the same area as the projected area of the grain. The diameter of the tabular silver halide grains for use in this invention is generally from 0.3 micron to 5.0 microns, and preferably from 0.5 micron to 3.0 microns. Also, the thickness of the tabular silver halide grains is generally less than about 0.4 micron, preferably less than 0.3 micron, and more preferably less than 0.2 micron.

In general, a tabular silver halide grain is a tabular grain having two parallel faces and hence the aforesaid "thickness" is shown by the distance between the two parallel faces constituting the tabular silver halide grain.

The tabular silver halide grains can be used in a mono-dispersed state of the grain sizes and/or thicknesses of the silver halide grains as described in Japanese Patent Publication No. 11386/72.

The mono-dispersed state of tabular silver halide grains refers to the dispersed system wherein about of the silver halide grains are within ±60%, are preferably within ±40%, of the number mean grain size. The number mean grain size is the number mean diameter of the projected area diameter of silver halide grains.

The ratio of the tabular silver halide grains contained in the photographic emulsion containing tabular silver halide grains for use in this invention is preferably at least 50%, more preferably at least 70%, and particularly preferably at least 90% of the total projected area of the silver halide grains.

The halogen composition of the tabular silver halide is preferably silver bromide, silver iodide, silver chlorobromide, silver chloroiodo-bromide, silver chloride, or silver iodochloride. Silver iodochloride is particularly preferred for high-speed color photographic materials of this invention. In the case of silver iodichloride, the content of silver iodide is usually less than about 40 mol%, preferably less than about 20 mol%, more preferably less than about 15 mol%. Also, for color photographic materials for printing, silver chlorobromide and silver bromide are particularly preferred.

The tabular silver halide grains may have a uniform halogen composition or may be composed of two or more phases having different halogen composition.

For example, in the case of using silver iodobromide, the tabular silver iodobromide grain may have a layer structure composed of plural phases having different iodide content. Preferred examples of the halogen composition of tabular silver halide grains and the halogen distribution in the silver halide grain are described in Japanese Patent Application (OPI) Nos. 13928/83, 99433/84, etc. In general, it is preferred that the desired relation of the relative iodide content of each phase of tabular silver halide grains is selected according to the content of development processing (e.g., the amount of a silver halide solvent contained in the color developer) which is applied to the color photographic materials containing the tabular grain silver halide emulsions.

The tabular silver halide grains may be junction type silver halide crystals formed by junctioning the crystals of an oxide such as PbO, etc., and the crystals of silver halide such as silver chloride or may be silver halide crystals formed by epitaxial growing (e.g., crystals formed by epitaxially growing silver chloride, silver iodobromide, silver iodide, etc., on silver bromide or crystals formed by epitaxially growing silver chloride, silver bromide, silver iodide, silver chloroiodide, etc., on a regular octahedral silver iodide). Examples of such are described in U.S. Pat. Nos. 4,435,501, 4,463,087, etc.

Also, the tabular silver halide grains may be of the type forming latent images mainly on the surface thereof or of the type forming latent images mainly in the inside thereof. The type of the silver halide grains can be properly selected according to the uses of the color photographic materials using the tabular silver halide grains, the depth of the latent images, which can be developed by a developer for processing the color photographic materials, in the inside of the grains.

Details of preferred use methods of the tabular silver halide grains are described in *Research Disclosure*, No. 22534 (January 1983), ibid, No. 25330 (May 1985). For example, the using method based on the relation of the thickness of tabular silver halide grains and the optical property thereof is disclosed therein.

The crystal structure may be uniform throughout the whole grain or may be composed of halogen composition different between the inside and outside of the silver halide grain. The structure may be also a layer structure. These silver halide grains are disclosed in British Patent No. 1,027,146, U.S. Pat. No. 3,505,068, 4,444,877, Japanese Patent Application (OPI) No. 143331/85, etc.

Also, the crystal structure of the silver halide grains may be composed of plural silver halides having different halogen composition junctioned with each other by epitaxial junction or may be composed of silver halide and other compound than silver halide, such as silver rhodanate, lead oxide, etc., junctioned with each other by epitaxial junction. These silver halide emulsion grains are disclosed in U.S. Pat. Nos. 4,094,684, 4,142,900, 4,459,353, British Patent No. 2,038,792, U.S. Pat. Nos. 4,349,622, 4,395,478, 4,433,501, 4,463,087, 3,656,962, 3,852,067, Japanese Patent Application (OPI) No. 62540/84, etc.

Furthermore, a mixture of silver halide grains having various crystal forms may be used in this invention.

For accelerating the ripening of silver halide emulsions, a silver halide solvent is useful. For example, it is known that the formation of the silver halide emulsion is performed in the existence of excessive amount of halide ions in a reaction vessel for accelerating the ripening of the silver halide emulsion. Accordingly, it is clear that the ripening can be accelerated simply by introducing a halide solution into the reaction vessel. Also, as a matter of course, other ripening agents can be used. In this case, the whole amount of the ripening agent can be compounded in the dispersion medium in the reaction vessel before the addition of an aqueous silver salt solution and an aqueous halide solution or the ripening agent may be introduced into the reaction vessel together with one or more of a halide, a silver salt, and a flocculant. In other modified embodiment, a ripening agent may be independently introduced at the step of the addition of a halide and a silver salt.

Other ripening agent than halide ions for use in this invention include ammonia, amine compounds and thiocyanates (e.g., alkali metal thiocyanates, in particular sodium thiocyanate and potassium thiocyaante, ammonium thiocyaante, etc.), etc. The use of a thiocyanate ripening agent are described in U.S. Pat. Nos. 2,222,264, 2,448,534, and 3,320,069. Also, the ordinary thioether ripening agents as described in U.S. Pat. Nos. 3,271,157, 3,574,628, and 3,737,313 can be also used. Furthermore, the thion compounds as described in Japanese Patent Application (OPI) Nos. 82408/78 and 144319/78 can be also used as ripening agent in this invention.

The properties of silver halide grains can be controlled by the presence of various compounds in the step of forming the precipitations of silver halide. Such compound(s) may exist from the first in a reaction vessel or may be added to the reaction vessel together with one or more of a halide, a silver salt, etc. Also, the properties of silver halide can be controlled by the existence of the compounds of copper, iridium, lead, bismuth, cadmium, zinc, chalcogens (e.g., sulfur, selenium, tellurium, etc.), or the compound of gold or a noble metal belonging to Group VII of the periodic table in the step of forming the precipitations of silver halide as described in U.S. Pat. Nos. 2,448,060, 2,628,167, 3,737,313, 3,772,031, *Research Disclosure*, Vol. 134, (June 1975), 13452, etc.

Also, the silver halide grains in silver halide emulsions can be subjected to internal reduction sensitization in the step of forming the precipitations thereof as described in Japanese Patent Publication No. 1410/83 and Moisar et al, *Journal of Photographic Science*, Vol. 25, 19–27(1977).

The silver halide emulsions for use in this invention are usually chemically sensitized. The chemical sensitization can be performed by using active gelatin as described in T. H. James, *The Theory of the Photographic Process*, 4th edition, pages 67–76, published by Macmillan, 1977 or may be performed by using a sensitizer such as sulfur, selenium, tellurium, gold, platinum, palladium, iridium, etc., or a combination of these sensitizers at a pAg of 5 to 10, a pH of 5 to 8, and a temperature of 30 to 80° C. as described in *Research Disclosure*, Vol. 120, 1974, May, 12008, ibid, *Research Disclosure*, Vol. 34, (June 975), 13452, U.S. Pat. Nos. 2,642,361, 3,297,446, 3,772,031, 3,857,711, 3,901,714, 4,266,018, 3,904,415, and British Patent No. 1,315,755. Also, it is suitable to perform the chemical sensitization in the presence of a gold compound and thiocyanate compound or in the existence of the sulfur-containing compounds described in U.S. Pat. Nos. 3,857,711, 4,266,018, and 4,054,457 or a sulfur compound such as hypo, a thiourea compound, a rhodanine series compound, etc.

The chemical sensitization can be performed in the presence of an auxiliary chemical sensitizer. As the auxiliary chemical sensitizer, compounds which are known to inhibit the formation of fog and increase sensitivity during the chemical sensitization, such as azaindenes, azapyridazines, azapyrimidines, etc. Specific examples of the auxiliary chemical sensitizers are described in U.S. Pat. Nos. 2,131,038, 3,411,914, 3,554,757, Japanese Patent Application (OPI) No. 126526/83, G. F. Duffin, *Photographic Emulsion Chemistry*, pages 138–143.

In addition to or in place of the chemical sensitization, a reduction sensitization can be applied using, for example, hydrogen as described in U.S. Pat. Nos. 3,891,446 and 3,984,249, using a reducing agent such as stannous chloride, thiourea dioxide, polyamine, etc., as described in U.S. Pat. Nos. 2,518,698, 2,743,182, and 2,743,183, or by a low-pAg (e.g., less than 5) and/or high-pH (e.g., higher than 8) treatment.

Also, by employing the chemical sensitization methods described in U.S. Pat. Nos. 3,917,485 and 3,966,476, the color sensitivity can be improved.

The silver halide photographic emulsions for use in this invention may be chemically sensitized by methine dyes, etc. The dyes used for the purpose include cyanine dyes, merocyanine dyes, complex cyanine dyes, complex merocyanine dyes, holopolar cyanine dyes, hemicyanine dyes, styryl dyes, and hemioxonol dyes. Particularly useful dyes are dyes belonging to cyanine dyes, merocyanine dyes and complex merocyanine dyes.

For these dyes can be applied nuclei which are usually utilized as basc heterocyclic nuclei. Examples of these nuclei are pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei formed by fusing an alicyclic hydrocarbon ring to the aforesaid nuclei or the nuclei formed by fusing an aromatic hydrocarbon ring to the aforesaid nuclei, i.e., indolenine nuclei, benzindolenine nuclei, indole nuclei, benzoxadole nuclei, naphthoxazole nuclei, benzothiazole nuclei, naphthothiazole nuclei, benzoselenazole nuclei, benzimidazole nuclei, quinone nuclei, etc. These nuclei may have a substituent on the carbon atom thereof.

For the merocyanine dyes or complex merocyanine dyes can be applied 5- or 6-membered heterocyclic nuclei such as pyrazolin-5-one nuclei, thihydantoin nuclei, 1-thiooxazolidine-2,4-dione nuclei, thiazolidine-2,4-dione nuclei, rhodanine nuclei, thiobarbituric acid nuclei, etc., as nuclei having a ketomethylene structure.

The sensitizing dyes described above may be used singly or as a combination thereof, and a combination of sensitizing dyes is frequently used for super color sensitization.

The silver halide emulsions for use in this invention may contain. Together with a sensitizing dye(s), a dye having a spectral sensitizing action by itself or a material which does not substantially absorb visible light and shows super color sensitization. Examples of such compounds are aminostylbenzene compounds substituted by a nitrogen-containing heterocyclic group described, for example, in U.S. Pat. Nos. 2,933,390 and 3,635,721, aromatic organic acid-formaldehyde condensation products described, for example, in U.S. Pat. No.

3,743,510, cadmium salts, azaindene compounds, etc. The combinations of the compounds described in U.S. Pat. Nos. 3,615,613, 3,615,641, 3,617,295, and 3,635,721 are particularly useful.

The silver halide emulsions for use in this invention may be spectrally sensitized in any stage of the preparation of the emulsions.

In general, spectral sensitizing dyes are added to silver halide emulsions which have been chemically sensitized before coating. However, it is disclosed to add sensitizing dyes to emulsions before the initiation of or during the chemical sensitizing of the emulsions in U.S. Pat. No. 4,425,426. It is also disclosed to add spectral sensitizing dyes to emulsions before the completion of the formation of the silver halide grains in U.S. Pat. Nos. 2,735,766, 3,628,960, 4,183,756, and 4,225,666.

In particular, it is disclosed in U.S. Pat. Nos. 4,183,756 and 4,225,666 described above that the merits of increasing photographic sensitivity and improvement of the adsorption of spectral sensitizing dyes to silver halide grains are obtained by adding the spectral sensitizing dyes to silver halide emulsions after the formation of stable nuclei for forming silver halide grains.

The silver halide photographic emulsions for the color photographic materials of this invention may further contain polyalkylene oxide or the derivatives such as the ethers, esters, amines, etc., thereof, thioether compounds, thiomorpholines, quaternary ammonium salt compounds, urethane derivatives, urea derivatives, imidazole derivatives, 3-pyrazolidones, etc., for increasing sensitivity, increasing contrast, or accelerating development. These additives are described in U.S. Pat. Nos. 2,400,352, 2,423,549, 2,716,062, 3,617,280, 3,772,021, 3,808,003, British Patent No. 1,488,991, etc.

The silver halide photographic emulsions for use in this invention can contain various kinds of compounds for the purposes of preventing the formation of fog during the production, storage or processing of the color photographic materials or stabilizing the photographic performance of the color photographic materials. Examples of such compounds are those known as antifoggants or stabilizers, for example, azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, etc.; mercaptopyrimidines; mercaptotriazines; thioketo compounds such as oxadolinethione, etc.; azaindenes such as triazaindenes, tetraazaindenes (in particular, 4-hydroxy-substituted (1,3,3a,7)tetraazaindenes), pentaazaindenes, etc.; benzenethiosulfonic acid; benzenesulfinic acid; benzenesulfonic acid amide, etc.

In this invention, various color couplers can be used. The color coupler means a compound capable of forming a dye by causing a coupling reaction with the oxidation product of an aromatic primary amine developing agent. Typical color couplers are naphtholic or phenolic compounds, pyrazoloine or pyrazoloazole series compounds, and open chain or heterocyclic ketomethylene compounds. Specific examples of these cyan, magenta, and yellow couplers which can be used in this invention are described in the patents cited in *Research Disclosure*, 17643 (December 1978), Paragraph VII-D and ibid., 18717 (November 1979).

It is preferred that the color couplers existing in the color photographic materials of this invention are rendered non-diffusible by having a ballast group or by being polymerized. Also, in this invention, two-equivalent couplers having a coupling releasing group as a substituent are better than four-equivalent couplers having only hydrogen atoms at the coupling active position in the point of reducing the amount of silver for the color photographic materials. Furthermore, couplers giving colored dyes having a proper diffusibility, non-coloring couplers, DIR couplers releasing a development inhibitor with a coupling reaction, or couplers releasing a development accelerator with coupling reaction can be used in this invention.

As yellow couplers for use in this invention, there are typically oil protect-type acylacetamide series couplers and specific examples thereof are described in U.S. Pat. Nos. 2,407,210, 2,875,057, 3,265,506, etc. For this invention, two-equivalent yellow couplers are preferably used and specific examples thereof are the oxygen atom releasing type yellow couplers described in U.S. Pat. Nos. 3,408,194, 3,447,928, 3,933,501, 4,022,620, etc., and the nitrogen atom releasing type yellow couplers described in Japanese Patent Publication No. 10739/83, U.S. Pat. Nos. 4,401,752, 4,326,024, *Research Disclosure*, 18053 (April 1979), British Patent No. 1,425,020, West German Patent Application (OLS) Nos. 2,219,917, 2,261,361, 2,329,587, 2,433,812, etc. In these couplers, $\alpha$-pivaloylacetanilido series couplers are excellent in fastness, in particular light fastness of colored dyes formed, while $\alpha$-benzoylacetanilido series couplers give high coloring density.

As the magenta couplers for use in this invention, there are oil protect-type indazolone series couplers, cyanoacetyl series couplers, preferably 5-pyrazolone series couplers and pyrazoloazole series couplers such as pyrazolotriazoles, etc. As the 5-pyrazolone series couplers, the couplers the 3-position of which is substituted by an arylamino group or an acylamino group are preferred from the view points of the hue of colored dyes and coloring density and specific examples of such couplers are described in U.S. Pat. Nos. 2,311,082, 2,343,703, 2,600,788, 2,908,573, 3,062,653, 3,152,896, 3,936,015, etc. As a releasing group for two-equivalent 5-pyrazolone series magenta couplers, the nitrogen atom releasing group described in U.S. Pat. No. 4,310,619 and the arylthio group described in U.S. Pat. No. 4,351,897 are particularly preferred. Also, the 5-pyrazolone magenta couplers having the ballast groups described in Eurolean Patent No. 73,636 give high coloring density.

As the pyrazoloazole series magenta couplers, there are the pyrazolobenzimidazoles described in U.S. Pat. No. 3,061,432, preferably the pyrazolo(5,1c)(1,2,4)-triazoles described in U.S. Pat. No. 3,725,067, the pyrazolotetrazoles described in *Research Disclosure*, 24220 (June 1984), and the pyrazolopyrazoles described in *Research Disclosure*, 24230 (June 1984) and Japanese Patent Application (OPI) No. 43659/85. The imidazo(1,2b)pyrazoles described in U.S. Pat. No. 4,500,630 and the pyrazolo(1,5-b)(1,2,4)triazoles described in U.S. Pat. No. 4,540,654 are particularly preferred in the point of giving colored dyes having less yellow side absorption and high light fastness.

As described hereinbefore, in the main embodiment of this invention, phenolic cyan dye-forming couplers (cyan couplers) having an arylureido group at the 2-position and a carbonamido group at the 5-position are used for the color photographic materials. In this invention, however, other cyan couplers can be used together with the aforesaid phenolic cyan couplers of this invention. As such cyan couplers which can be used together with the cyan couplers in this invention, there are oil protect-type naphtolic or phenolic couplers and specific examples thereof ar the naphtholic couplers described in U.S. Pat. No. 2,474,293, and preferably the oxygen atom releasing-type two-equivalent naphtholic couplers described in U.S. Pat. Nos. 4,052,212, 4,146,396, 4,228,233, and 4,296,200. Also, practical examples of the phenolic couplers are described in U.S. Pat. Nos. 2,369,929, 2,801,171, 2,772,162, 2,895,826, etc. Cyan couplers having high fastness to humidity and temperature can be preferably used in this invention. Typical examples of such cyan couplers are the phenolic cyan couplers having an alkyl group of two or more carbon atoms at the metaposition of the phenol nucleus described in U.S. Pat. No. 3,772,002, the 2,5-diacylamino-substituted phenolic cyan couplers described in U.S. Pat. Nos. 2,772,162, 3,958,308, 4,126,396, 4,334,011, 4,327,173, West German Patent Application (OPI) No. 3,329,729, European Patent No. 121,365, etc., and the phenolic cyan couplers having a phenylureido group at the 2-position and an acylamino group at the 5-position described in U.S. Pat. Nos. 3,446,622, 4,333,999, 4,451,559, 4,427,767, etc. The cyan couplers having a sulfonamido group, an amido group, etc., at the 5-position of the naphthol nucleus as a substituent described in Japanese Patent Application (OPI) No. 237448/85, Japanese Patent Application Nos. 264277/84, and 268135/84 are also excellent hastness of colored images formed and can be preferbly used in this invention.

For correcting undesired absorptions in the short wavelength region due to dyes formed from magenta couplers and cyan couplers, it is preferred to use colored couplers together with the aforesaid couplers for color negative photographic materials for photographing. Examples of such colored couplers are the yellow-colored magenta couplers described in U.S. Pat. No. 4,163,670, Japanese Patent Publication No. 39413/82, etc., and the magenta-colored cyan couplers described in U.S. Pat. Nos. 4,004,929, 4,138,258, British Patent No. 1,146,368, etc.

Furthermore, in this invention, the graininess of color images formed can be improved by using a coupler giving a colored dye having a proper diffusibility together with the aforesaid couplers. Specific examples of such controlled blurring couplers are described in U.S. Pat. No. 4,366,237 and British Patent No. 2,125,570 for magenta couplers and in European Patent No. 96,570 and West German Patent Application (OLS) No. 3,234,533 for yellow, magenta, or cyan couplers.

The dye-forming couplers and the above-described specific couplers for use in this invention may form dimers or more oligomers. Typical examples of the polymerized couplers are described in U.S. Pat. Nos. 3,451,820 and 4,080,211. Also, examples of polymerized magenta couplers are described in British Patent No. 2,102,173, U.S. Pat. No. 4,367,282, Japanese Patent Application Nos. 75041/85 and 113596/85.

The various kinds of couplers for use in this invention may exist in a same photographic layer of a color photographic material as a combination of two or more kinds thereof for meeting the characteristics required for the color photographic material or a same kind of coupler may exist in two or more different photographic layers.

A standard amount of a color coupler is in the range of from 0.001 to 1 mol per mol of the silver halide in the photographic emulsion layer. It is preferred that the addition amount of the yellow coupler is from 0.01 to 0.5 mol, that of the magenta coupler is from 0.003 to 0.3 mol, and that of the cyan coupler is from 0.002 to 0.3 mol per mol of silver halide.

The color photographic materials of this invention may contain so-called DIR couplers releasing a development inhibitor with development.

As DIR couplers, there are the couplers releasing a heterocyclic mercapto series development inhibitor described in U.S. Pat. No. 3,227,554; the couplers releasing a benzotriazole derivative as a development inhibitor described in Japanese Patent Publication No. 9942/83; the so-called non-coloring DIR couplers described in Japanese Patent Publication No. 16141/76; the couplers releasing a nitrogen-containing heterocyclic development inhibitor accompanied by the decomposition of methylol after the release thereof described in Japanese Patent Application (OPI) No. 90932/77; the couplers releasing a development inhibitor accompanied by a intramolecular nucleating reaction after release thereof described in U.S. Pat. No. 4,248,962 and Japanese Patent Application (OPI) No. 56837/82; the couplers releasing a development inhibitor by an electron transfer through a covalent system after release thereof described in Japanese Patent Application (OPI) Nos. 114946/81, 154234/82, 188035/82, 98728/83, 209736/83, 209737/83, 209738/83, 209739/93, 209740/83, etc.; the couplers releasing a diffusible development inhibitor the development inhibiting faculty thereof is inactivated in the color developer described in Japanese Patent Application (OPI) Nos. 151944/82, 217932/83, etc.; the couplers releasing a reactive compound to form a development inhibitor by a reaction 1 n layer at development or inactive the development inhibitor described in Japanese Patent Application (OPI) Nos. 182438/85, 184248/85, etc.

In the DIR couplers described above, the developer inactivation type couplers typified by Japanese Patent Application (OPI) No. 151944/82; the timing type couplers described in U.S. Pat. No. 4,248,962 and Japanese Patent Application (OPI) No. 154232/82; and the reaction type couplers described in Japanese Patent Application (OPI) No. 184248/85 are more preferred in the combination with the present invention. In the aforesaid preferred DIR couplers, the development inactivation type DIR couplers described in Japanese Patent Application (OPI) Nos. 151944/82, 217932/83, 75474/84, 82214/84, 82214/84, 90438/84, etc., and the reaction type DIR couplers described in Japanese Patent Application (OPI) No. 184248/85 are particularly preferred in this invention.

For the color photographic materials of this invention, a compound imagewise releasing a nucleating agent or a development accelerator, or the precursor therefor (hereinafter, is referred to as "development accelerator, etc.") at development. Typical examples of the compound are described in British Patent No. 2,097,140 and 2,131,188. The aforesaid compound is a DAR coupler, i.e., the coupler releasing a development accelerator by a coupling reaction with the oxidation product of an aromatic primary amine developing agent.

It is preferred the development accelerator, etc., released from the DAR coupler have an absorptive group for silver halide and specific examples of such a DAR coupler are described in Japanese Patent Application (OPI) Nos. 157638/84 and 170840/84. The DIR coupler releasing an N-acyl-substituted hydrazine having a monocyclic or condensed heterocyclic ring as the adsorptive group at the sulfur atom or nitrogen atom from the coupling active position of the coupler is particularly preferred and specific examples of the coupler are described in Japanese Patent Application (OPI) No. 128446/85.

The compound having a development accelerator moiety in the coupler residue thereof described in Japanese patent Application (OPI) No. 37556/85, and the compound releasing a development accelerator by the oxidation reduction reaction with a developing agent described in Japanese Patent Application (OPI) No. 107029/85 can be also used for the color photographic materials of this invention.

It is preferred that the DAR couplers exist in the light-sensitive silver halide emulsion layers of the color photographic material of this invention and also it is preferred that substantially light insensitive silver halide grains are used for at least one of the photographic constituting layers as described in Japanese Patent Application (OPI) Nos. 172640/84 and 128429/85.

Moreover, the color photographic materials of this invention may further contain hydroquinone derivatives, aminophenol derivatives, amines, gallic acid derivatives, catechol derivatives, ascorbic acid derivatives, non-coloring couplers, sulfonamidophenol derivatives, etc., as anti-foggant or color mixing preventing agent.

The following examples are intended to illustrate the present invention in detail but not to limit it in any way.

EXAMPLE 1

A multilayer color photographic material (Sample 101) having the layers of the compositions shown below on a cellulose triacetate film support having a subbing layer was prepared.

In addition, the coating amount (coverage) of each component was shown by the unit of $g/m^2$ as silver for silver halide emulsion and colloid silver, by the unit of $g/m^2$ for additives and gelatin, and by mol number per mol of silver halide in a same silver halide emulsion layer for a sensitizing dye incorporated in the emulsion layer.

Layer 1 (Antihalation Layer)

| | |
|---|---|
| Black Colloid Silver | 0.2 |
| Gelatin | 1.3 |
| Colored Coupler C-1 | 0.06 |
| Ultraviolet Absorbent UV-1 | 0.1 |
| Ultraviolet Absorbent UV-2 | 0.2 |
| Dispersing Oil Oil-1 | 0.01 |
| Dispersing Oil Oil-2 | 0.01 |

Layer 2 (Interlayer)

| | |
|---|---|
| Gelatin | 1.0 |
| Colored Coupler C-2 | 0.02 |
| Dispersing Oil Oil-1 | 0.1 |

Layer 3 (1st Red-Sensitive Emulsion Layer)

| | |
|---|---|
| Silver Iodobromide Emulsion (mean grain size 0.5 micron, AgI 5 mol %) | 1.5 |
| Gelatin | 1.5 |
| Sensitizing Dye I | $1.0 \times 10^{-4}$ |

-continued

| | |
|---|---|
| Sensitizing Dye II | $3.0 \times 10^{-4}$ |
| Sensitizing Dye III | $3.0 \times 10^{-5}$ |
| Coupler (IV-1) | 0.18 |
| Coupler (VI-2) | 0.17 |
| Coupler C-8 | 0.04 |
| Coupler C-2 | 0.02 |
| Coupler C-3 | 0.02 |
| Dispersing Oil Oil-1 | 0.14 |
| Dispersing Oil Oil-3 | 0.14 |

Layer 4 (2nd Red-Sensitive Emulsion Layer)

| | |
|---|---|
| Silver Iodobromide Emulsion (mean grain size 0.9 micron, AgI 7 mol %) | 1.2 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler (IV-1) | 0.12 |
| Coupler (VI-2) | 0.12 |
| Coupler C-8 | 0.03 |
| Coupler C-2 | 0.03 |
| Dispersing Oil Oil-1 | 0.05 |
| Dispersing Oil Oil-3 | 0.10 |
| Gelatin | 1.5 |

Layer 5 (3Red-Sensitive Emulsion Layer)

| | |
|---|---|
| Silver Iodobromide Emulsion (mean grain size 0.5 micron, AgI 10 mol %) | 2.0 |
| Gelatin | 1.0 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-6 | 0.05 |
| Coupler C-7 | 0.09 |
| Coupler C-2 | 0.03 |
| Dispersing Oil Oil-1 | 0.01 |
| Dispersing Oil Oil-2 | 0.05 |

Layer 6 (Interlayer)

| | |
|---|---|
| Gelatin | 1.0 |
| Compound Cpd-A | 0.03 |
| Dispersing Oil Oil-1 | 0.05 |
| Dispersing Oil Oil-2 | 0.05 |

Layer 7 (1st Green-Sensitive Emulsion Layer)

| | |
|---|---|
| Silver Iodobromide Emulsion (mean grain size 0.5 micron, AgI 6 mol %) | 1.0 |
| Sensitizing Dye IV | $5 \times 10^{-4}$ |
| Sensitizing Dye V | $2 \times 10^{-4}$ |
| Gelatin | 1.0 |
| Coupler C-9 | 0.2 |
| Coupler C-5 | 0.03 |
| Coupler C-4 | 0.01 |
| Coupler C-1 | 0.03 |
| Dispersing Oil Oil-1 | 0.5 |

Layer 8 (2nd Red-Sensitive Emulsion Layer)

| | |
|---|---|
| Gelatin | 1.8 |
| Silver Iodobromide Emulsion (mean grain size 0.5 micron, AgI 8 mol %) | 1.0 |
| Sensitizing Dye IV | $5 \times 10^{-4}$ |
| Sensitizing Dye V | $2 \times 10^{-4}$ |
| Coupler C-9 | 0.25 |

-continued

| | |
|---|---|
| Coupler C-1 | 0.03 |
| Coupler C-10 | 0.015 |
| Coupler C-5 | 0.03 |
| Dispersing Oil Oil-1 | 0.2 |

Layer 9 (3rd Green-Sensitive Emulsion Layer)

| | |
|---|---|
| Silver Iodobromide Emulsion (mean grain size 0.5 micron, AgI 12 mol %) | 2.0 |
| Gelatin | 2.0 |
| Sensitizing Dye IV | $3.5 \times 10^{-4}$ |
| Sensitizing Dye V | $1.4 \times 10^{-4}$ |
| Coupler C-11 | 0.05 |
| Coupler C-12 | 0.01 |
| Coupler C-13 | 0.08 |
| Coupler C-1 | 0.02 |
| Coupler C-15 | 0.02 |
| Dispersing Oil Oil-1 | 0.10 |
| Dispersing Oil Oil-2 | 0.05 |

Layer 10 (Yellow Filter Layer)

| | |
|---|---|
| Gelatin | 1.2 |
| Yellow Colloid Silver | 0.08 |
| Compound Cpd-B | 0.1 |
| Dispersing Oil Oil-1 | 0.3 |

Layer 11 (1st Blue-Sensitive Emulsion Layer)

| | |
|---|---|
| Mono-Dispersed Silver Iodobromide Emulsion (mean grain size 0.6 micron, AgI 4 mol % | 0.4 |
| Gelatin | 1.0 |
| Sensitizing Dye V | $2 \times 10^{-4}$ |
| Coupler C-14 | 0.7 |
| Coupler C-5 | 0.07 |
| Dispersing Oil Oil-1 | 0.2 |

Layer 12 (2nd Blue-Sensitive Emulsion Layer)

| | |
|---|---|
| Silver Iodobromide Emulsion (mean grain size 1.0 micron, AgI 9 mol %) | 0.4 |
| Gelatin | 0.6 |
| Sensitizing Dye v | $1 \times 10^{-4}$ |
| Coupler C-14 | 0.20 |
| Dispersing Oil Oil-1 | 0.07 |

Layer 13 (3rd Blue-Sensitive Emulsion Layer)

| | |
|---|---|
| Silver Iodobromide Emulsion (mean grain size 1.9 micron, AgI 12 mol %) | 0.7 |
| Gelatin | 0.7 |
| Coupler C-14 | 0.2 |
| Dispersing Oil Oil-2 | 0.2 |

Layer 14 (1st Protective Layer)

| | |
|---|---|
| Gelatin | 0.8 |
| Ultraviolet Absorbent UV-1 | 0.1 |
| Ultraviolet Absorbent UV-2 | 0.2 |
| Dispersing Oil Oil-1 | 0.01 |
| Dispersing Oil Oil-2 | 0.01 |

Layer 15 (2nd Protective Layer)

| | |
|---|---|
| Fine Grain Silver Bromide (mean grain size 0.07 micron) | 0.20 |
| Gelatin | 0.45 |
| Polymethyl methacrylate Particles (diameter 2.0 microns) | 0.05 |
| Hardening Agent H-1 | 0.7 |
| Formaldehyde Scavenger S-1 | 0.15 |
| Formaldehyde Scavenger S-2 | 0.15 |

(Sample 102)

By following the same procedure as Sample 101 except that Couple (VI-2) in Layer 3 and Layer 4 of Sample 101 was replaced with an equimolar amount of Coupler (VI-1), Sample 102 was prepared.

(Sample 103 to 105)

By following the same procedure as Sample 102 except that Coupler (IV-1) in Layer 3 and Layer 4 of Sample 102 was replaced with an equimolar amount of Coupler (IV-5) in this invention, cyan coupler Cp-1 usd in U.S. Pat. No. 4,552,834, and cyan coupler Cp-2, respectively, Samples 103, 104, and 105 were prepared respectively.

(Sample 106 to 110)

By following the same procedure as Samples 101 to 105, respectively, except that Compound (I-1) of this invention was added to Layer 6 of Samples 101 to 105 at a coverage of 0.45 g/m$^2$, Samples 106 to 110 were prepared.

(Samples 111 to 115)

By following the same procedure as Samples 101 to 105, respectively, except that Compound (II)-(3) of this invention was added to Layer 6 of Samples 101 to 105, Samples 111 to 115 were prepared.

Each of the samples thus prepared was continuously imagewise exposed at Maximum 10 CMS using using a tungsten light source corrected to 4800° K with a color temperture conversion filter, subjected to the following color development processing, and the photographic performance of each sample was determined. Also, other sets of the samples were stepwise exposed, subjected to the same color development processing, and the remaining silver amount at an exposure amount of 1 CMS was measured for each sample by a fluorescent X-ray method.

Furthermore, after allowing to stand the strips thus processed for 5 days under the conditions of 80° C. and 60% in relative humidity, the density measurement was performed.

The reduction ratios of cyan density 1.0 of thus measured are shown in Table 1 below.

Color Development Processing

| | |
|---|---|
| Color Development | 3 min. 15 sec. |
| Stop | 1 min. 00 sec. |
| Bleach | 2 min. 00 sec. |
| Wash | 2 min. 10 sec. |
| Fix | 4 min. 20 sec. |
| Wash | 3 min. 15 sec. |
| Stabilization | 1 min. 05 sec. |

The compositions of the processing liquids used for the aforesaid steps were as follows.

Color Developer

| | |
|---|---|
| Diethylenetriaminetetraacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N-Ethyl-N-β-hydroxyethylamino)-2-methylaniline Sulfate | 4.5 g |
| Water to make | 1.0 liter |
| | pH 10 |

Stop Liquid

| | |
|---|---|
| Glacial Acetic Acid | 20.0 g |
| Sodium Sulfite | 10.0 g |
| Water to make | 1.0 liter |
| | pH 4.5 |

Bleach Liquid

| | |
|---|---|
| Ethylenediaminetetraacetic Acid Ferric Ammonium Salt | 100.0 g |
| Ethylenediaminetetraacetic Acid Disodium Salt | 10.0 g |
| Ammonium Bromide | 150.0 g |
| Ammonium Nitrate | 10.0 g |
| Aqueous Ammonia (28%) | 7.0 ml |
| Water to make | 1.0 liter |
| | pH 6.0 |

Fix Liquid

| | |
|---|---|
| Ethylenediaminetetraacetic Acid Disodium Salt | 1.0 g |
| Sodium Sulfite | 4.0 g |

-continued

| | |
|---|---|
| 70% Aqueous Solution of Ammonium Thiosulfite | 175.0 ml |
| Sodium Hydrogensulfite | 4.6 g |
| Water to make | 1.0 liter |
| | pH 6.6 |

Stabilization Liquid

| | |
|---|---|
| Formalin (40 wt % formaldehyde solution) | 2.0 ml |
| Polyoxyethylene-p-monophenylether | 0.3 g |
| Water to make | 1.0 liter |

Cp-1

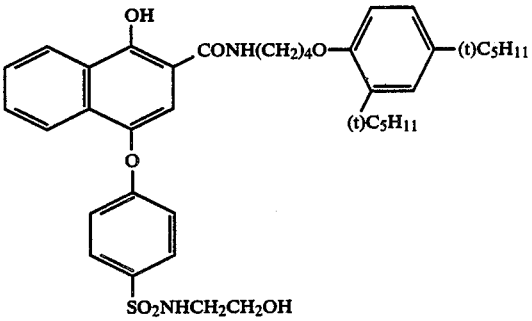

(Coupler described in U.S. Pat. No. 4,552,834)

Cp-2

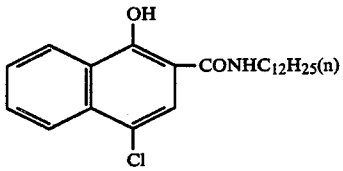

(Coupler used in Japanese patent Application No. 95630/78)

Then, the chemical structures such and the chemical names of the compounds used in this example are shown below.

UV-1

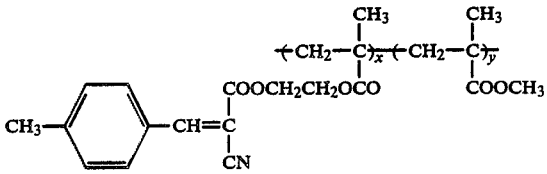

x/y = 7/3 (by weight ratio) Average molecular weight 20,000

UV-2

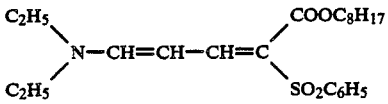

| | |
|---|---|
| Tricresyl Phosphate | Oil-1 |
| Dibutyl Phthalate | Oil-2 |
| Bis(2-ethylhexyl) Phthalate | Oil-3 |

-continued
C-1
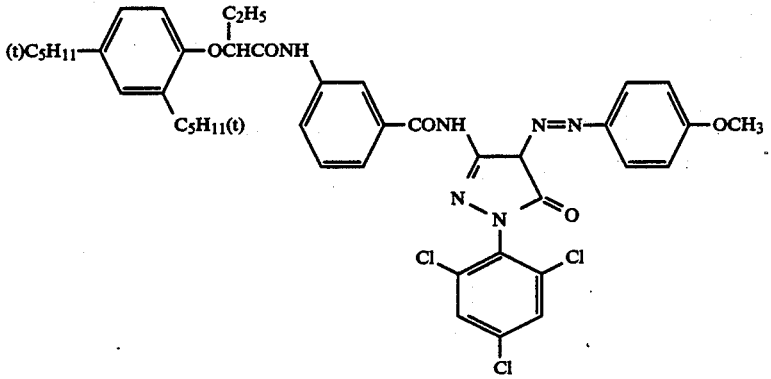
C-2
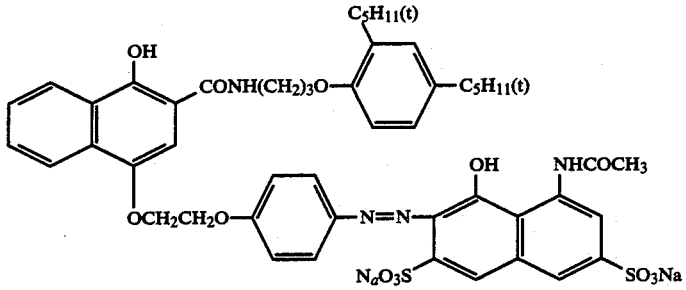
C-3
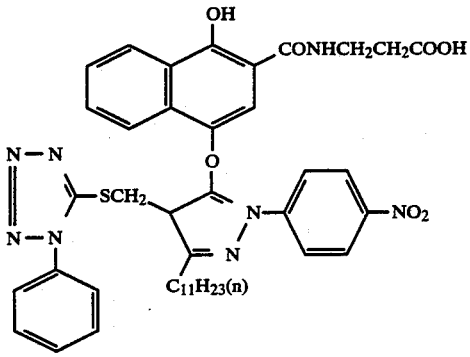
C-4
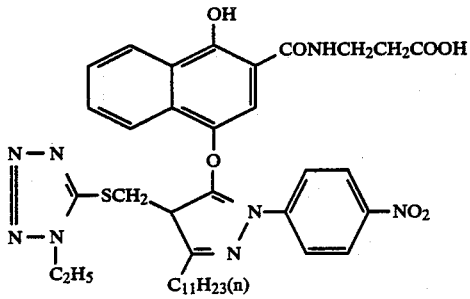
C-5
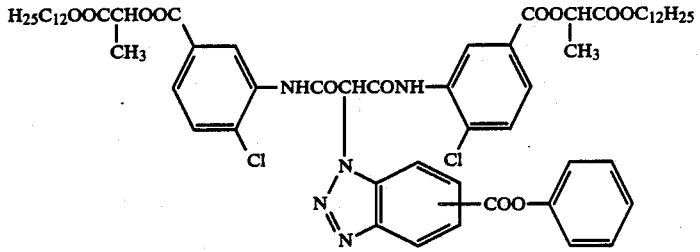

-continued
C-6
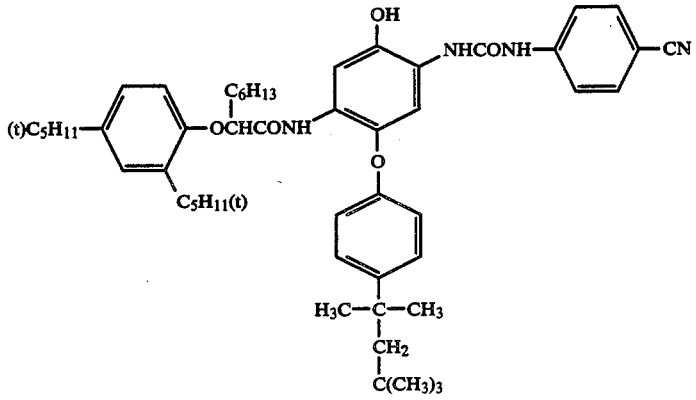
C-7
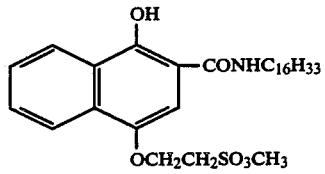
C-8
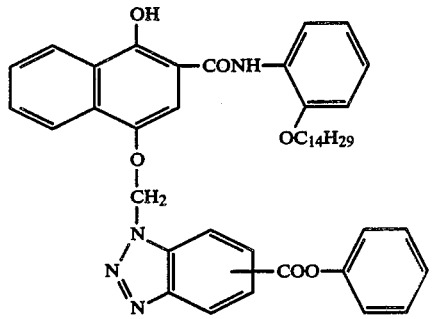
C-9
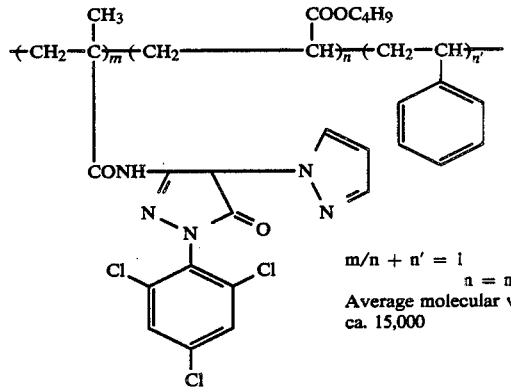
m/n + n' = 1
n = n'
Average molecular weight ca. 15,000
C-10
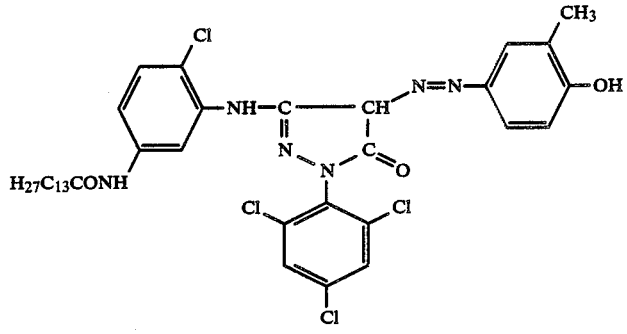

-continued
C-11
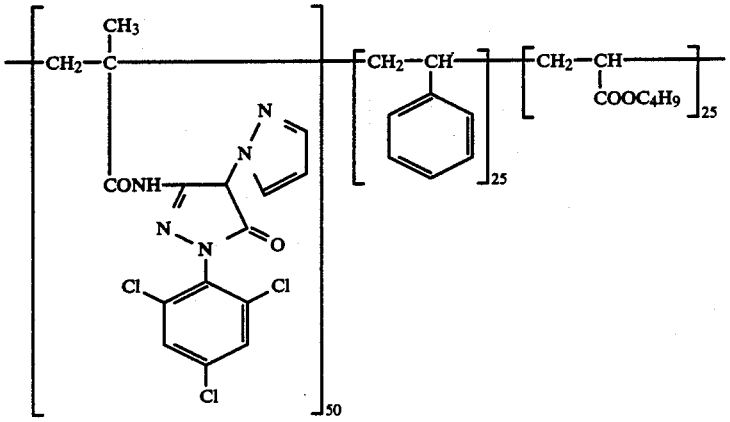
Average molecular weight 15,000
C-12
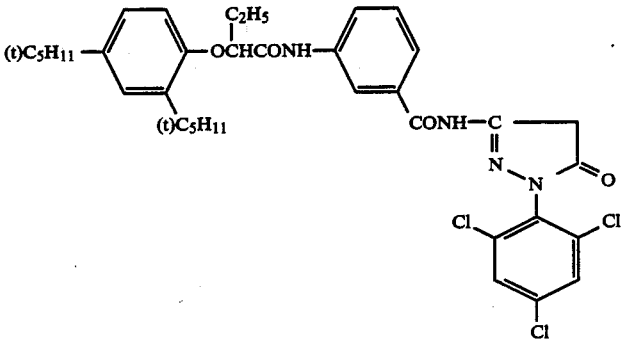
Average molecular weight 15,000
C-13
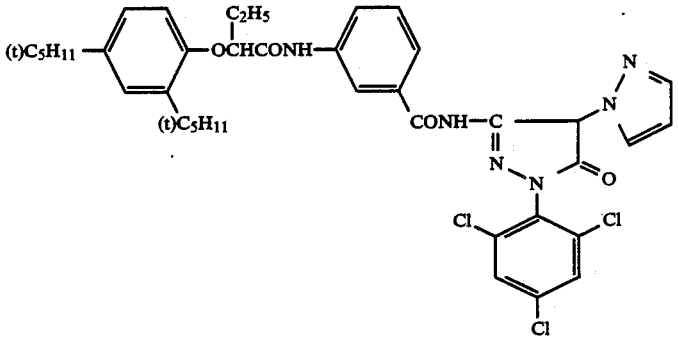
Cpd A
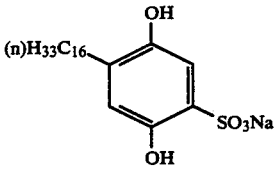
Cpd B
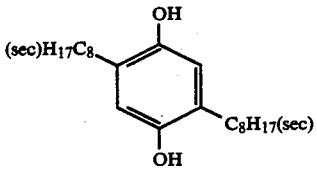

-continued
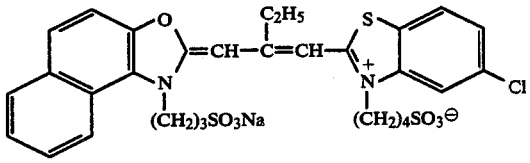
Sensitizing Dye I
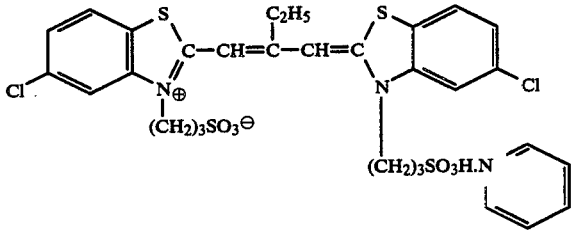
Sensitizing Dye II
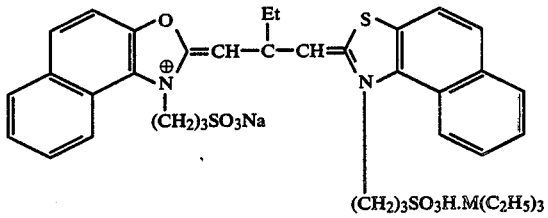
Sensitizing Dye III
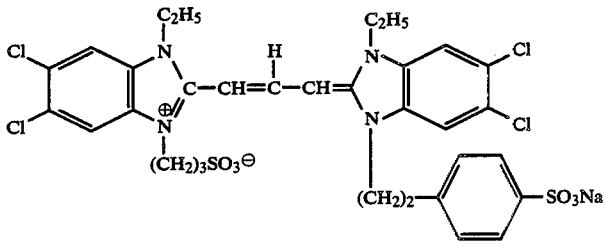
Sensitizing Dye IV
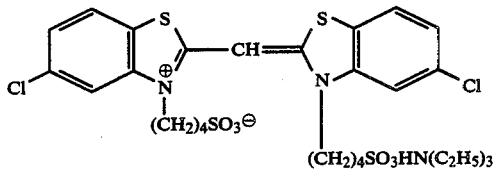
Sensitizing Dye VI
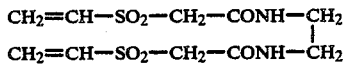
H-1
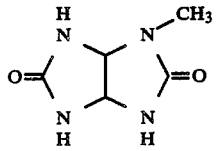
S-1
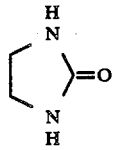
S-2

TABLE 1

| Sample No. | Couplers Added to Layers 3 and 4 | Additive for Layer 6 | Relative[1] Sensitivity of Red-Sensitive Layers | Remaining Silver Amount ($\mu g/m^2$) | Reduction of Cyan Density after Allowing to Stand for 5 Days at 80° C., 60% RH (%) |
|---|---|---|---|---|---|
| 101 | IV-1, IV-2 | — | 0.00 | 16.5 | 3 |
| 102 | IV-1 | — | −0.04 | 16.7 | 4 |
| 103 | IV-5 | — | −0.02 | 16.5 | 3 |
| 104 | Cp-1 | — | −0.01 | 16.3 | 18 |
| 105 | Cp-2 | — | −0.04 | 16.5 | 16 |
| 106 | IV-1, IV-2 | I-1 | 0.00 | 6.8 | 3 |
| 107 | IV-1 | " | −0.03 | 7.0 | 4 |
| 108 | IV-5 | " | −0.01 | 6.9 | 3 |
| 109 | Cp-1 | " | −0.01 | 6.8 | 19 |
| 110 | Cp-2 | " | −0.04 | 7.0 | 17 |
| 111 | IV-1, IV-2 | II-3 | 0.02 | 6.2 | 3 |
| 112 | IV-1 | " | −0.02 | 6.2 | 4 |
| 113 | IV-5 | " | −0.01 | 6.2 | 4 |
| 114 | Cp-1 | " | 0.01 | 6.1 | 18 |
| 115 | Cp-2 | " | −0.04 | 6.4 | 17 |

Notes:
[1]Relative value shown by the logarithm of the reciprocal of the exposure amount giving the density of fog +0.5 with that of Sample 101 being 0.
Sample Nos. 101 to 105, 109, 110, 114, and 115 are the comparative samples, and other are the samples of the present invention.

From the results shown in Table 1 above, it is clear that Samples 106 to 108 using the combination of this invention show good storability of cyan dye images as compared to Samples 104, 105, 109, 110, 114 and 115 using combinations of other couplers than those in this invention (e.g., Sample 109 using the combination of the couplers described in U.S. Pat. No. 4,552,834) and also show less residual silver as compared to Samples 101 to 105 without using the bleach accelerators in this invention and the effectiveness of this invention has been confirmed.

EXAMPLE 2

Samples as in Example 1 were exposed as in Example 1, processed by the same manner as Example 1 except that the stopping step was omitted form the whole color development processing steps, and the relative sensitivity of each red-sensitive layers and the residual silver amount at an exposure amount of 1 CMS were measured. The results are shown in Table 2 below.

As shown in Table 1 above and Table 2 below, it can be seen that the samples of this invention give remarkably less residual silver and show good color image preservability as compared with the comparison examples.

TABLE 2

| Sample No. | Relative Sensitivity of Red-Sensitive Layer | Remaining Silver Amount ($\mu g/cm^2$) | Reduction of Cyan Dye Image under 80° C., 60% RH (%) |
|---|---|---|---|
| 101 | 0.00 | 17.2 | 3 |
| 102 | −0.04 | 17.4 | 4 |
| 103 | −0.02 | 17.3 | 3 |
| 104 | 0.02 | 17.1 | 21 |
| 105 | −0.02 | 17.5 | 18 |
| 106 | 0.00 | 6.8 | 3 |
| 107 | −0.04 | 7.0 | 3 |
| 108 | −0.01 | 6.9 | 3 |
| 109 | 0.03 | 6.9 | 20 |
| 110 | −0.02 | 7.1 | 17 |
| 111 | 0.02 | 6.5 | 3 |
| 112 | −0.01 | 6.6 | 4 |
| 113 | 0.00 | 6.6 | 3 |
| 114 | 0.02 | 6.7 | 21 |

TABLE 2-continued

| Sample No. | Relative Sensitivity of Red-Sensitive Layer | Remaining Silver Amount ($\mu g/cm^2$) | Reduction of Cyan Dye Image under 80° C., 60% RH (%) |
|---|---|---|---|
| 115 | −0.01 | 6.8 | 17 |

Note:
Sample Nos. 101 to 105, 109, 110, 114, and 115 are the comparative samples, and others are the samples of the present invention.

EXAMPLE 3

A multilayer color photographic material having the layers of the compositions shown below on a cellulose triacetate film support having subbing layer was prepared.

In addition, the coating amount (coverage) was shown by the unit of $g/m^2$ as silver for silver halide and colloid silver, by the unit of $g/m^2$ for additives and gelatin, and by the mol number per mol of the silver halide in the same photographic layer for sensitizing dyes.

Layer 1 (Antihalation Layer)

| | |
|---|---|
| Black Colloid Silver | 0.17 |
| Gelatin | 1.3 |
| Colored Coupler C-1 | 0.06 |
| Ultraviolet Absorbent UV-1 | 0.1 |
| Ultraviolet Absorbent UV-2 | 0.2 |
| Dispersing Oil Oil-1 | 0.01 |
| Dispersing Oil Oil-2 | 0.01 |
| Desilvering Accelerator I-1 | shown in Table 4 |
| Desilvering Accelerator I-9 | shown in Table 4 |
| Desilvering Accelerator III | shown in Table 4 |

Layer 2 (Interlayer)

| | |
|---|---|
| Gelatin | 1.0 |
| Colored Coupler C-2 | 0.02 |
| Dispersing Oil Oil-1 | 0.1 |

Layer 3 (1st Red-Sensitive Emulsion Layer)

| | |
|---|---|
| Silver Iodobromide Emulsion (mean grain size 0.3 micron) | 0.51 |
| Gelatin | 0.6 |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| Coupler C-3 | 0.06 |
| Coupler C-4 | 0.06 |
| Coupler C-8 | 0.04 |
| Coupler C-2 | 0.03 |
| Dispersing Oil Oil-1 | 0.03 |
| Dispersing Oil Oil-3 | 0.012 |

Layer 4 (2nd Red-Sensitive Emulsion Layer)

| | |
|---|---|
| Silver Iodobromide Emulsion (mean grain size 0.5 micron) | 0.89 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-3 | 0.24 |
| Coupler C-4 | 0.24 |
| Coupler C-8 | 0.04 |
| Coupler C-2 | 0.04 |
| Dispersing Oil Oil-1 | 0.05 |
| Dispersing Oil Oil-3 | 0.10 |

Layer 5 (3rd Red-Sensitive Emulsion Layer)

| | |
|---|---|
| Silver Iodobromide Emulsion (mean grain size 0.7 micron) | 1.26 |
| Gelatin | 1.0 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-6 | 0.05 |
| Coupler C-7 | 0.1 |
| Coupler C-2 | 0.03 |
| Dispersing Oil Oil-1 | 0.01 |
| Dispersing Oil Oil-2 | 0.05 |

Layer 6 (Interlayer)

| | |
|---|---|
| Gelatin | 1.0 |
| Compound Cpd-A | 0.03 |
| Dispersing Oil Oil-1 | 0.05 |
| Dispersing Oil Oil-2 | 0.05 |
| Desilvering Accelerator | shown in Table 4 |

Layer 7 (1st Green-Sensitive Emulsion Layer)

| | |
|---|---|
| Silver Iodobromide Emulsion (mean grain size 0.3 micron) | 0.38 |
| Sensitizing Dye IV | $5 \times 10^{-4}$ |
| Sensitizing Dye V | $2 \times 10^{-4}$ |
| Gelatin | 1.0 |
| Coupler C-9 | 0.2 |
| Coupler C-5 | 0.03 |
| Coupler C-1 | 0.03 |
| Dispersing Oil Oil-1 | 0.5 |

Layer 8 (2nd Red-Sensitive Emulsion Layer)

| | |
|---|---|
| Silver Iodobromide Emulsion (mean grain size 0.5 micron) | 0.51 |

-continued

| | |
|---|---|
| Sensitizing Dye VI | $5 \times 10^{-4}$ |
| Sensitizing Dye V | $2 \times 10^{-4}$ |
| Coupler C-9 | 0.25 |
| Coupler C-1 | 0.03 |
| Coupler C-10 | 0.015 |
| Coupler C-5 | 0.03 |
| Dispersing Oil Oil-1 | 0.2 |

Layer 9 (3rd Green-Sensitive Emulsion Layer)

| | |
|---|---|
| Silver Iodobromide Emulsion (mean grain size 0.7 micron) | 1.08 |
| Gelatin | 1.0 |
| Sensitizing Dye IV | $3.5 \times 10^{-4}$ |
| Sensitizing Dye V | $1.4 \times 10^{-4}$ |
| Coupler C-11 | 0.05 |
| Coupler C-12 | 0.01 |
| Coupler C-13 | 0.08 |
| Coupler C-1 | 0.02 |
| Coupler C-15 | 0.02 |
| Dispersing Oil Oil-1 | 0.10 |
| Dispersing Oil Oil-2 | 0.05 |

Layer 10 (Yellow Filter Layer)

| | |
|---|---|
| Gelatin | 1.2 |
| Yellow Colloid Silver | 0.08 |
| Compound Cpd-B | 0.1 |
| Dispersing Oil Oil-1 | 0.3 |

Layer 11 (1st Blue-Sensitive Emulsion Layer)

| | |
|---|---|
| Mono-Dispersed Silver Iodobromide Emulsion (mean grain size 0.3 micron) | 0.51 |
| Sensitizing Dye V | $2 \times 10^{-4}$ |
| Coupler C-14 | 0.9 |
| Coupler C-5 | 0.07 |
| Dispersing Oil Oil-1 | 0.2 |

Layer 12 (2nd Blue-Sensitive Emulsion Layer)

| | |
|---|---|
| Silver Iodobromide Emulsion (mean grain size 1.5 micron) | 0.63 |
| Gelatin | 0.6 |
| Sensitizing Dye V | $1 \times 10^{-4}$ |
| Coupler C-14 | 0.25 |
| Dispersing Oil Oil-1 | 0.07 |

Layer 13 (1st Protective Layer)

| | |
|---|---|
| Gelatin | 0.8 |
| Ultraviolet Absorbent UV-1 | 0.1 |
| Ultraviolet Absorbent UV-2 | 0.2 |
| Dispersing Oil Oil-1 | 0.01 |
| Dispersing Oil Oil-2 | 0.01 |
| Desilvering Accelerator I-9 | shown in Table 4 |

Layer 14 (2nd Protective Layer)

| | |
|---|---|
| Fine Grain Silver Bromide (mean grain size 0.07 micron) | 0.5 |
| Gelatin | 0.45 |
| Polymethyl methacrylate Particles (diameter 1.5 microns) | 0.2 |

-continued

| | |
|---|---|
| Hardening Agent H-1 | 0.4 |
| Formaldehyde Scavenger S-1 | 0.5 |
| Formaldehyde Scavenger S-2 | 0.5 |

Each layer described above further contained a surface active agent as a coating aid in addition to the aforesaid components.

By employing the above-described constitution, Samples 201 to 208 were prepared while the silver iodide contents of the silver halide grains of each silver haldie emulsion layer and the kind and the addition amount of the desilvering accelerators of each layer were changed as shown in Table 3 and Table 4 described hereinafter.

The chemical structures of the compounds used in the example were as follows.

Desilvering Agent III

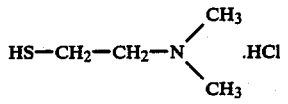

C-3

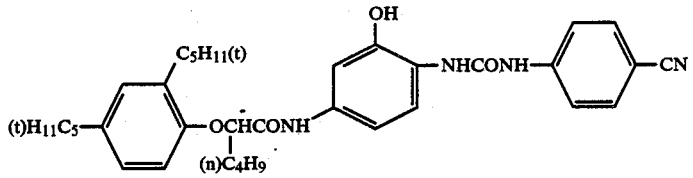

C-4

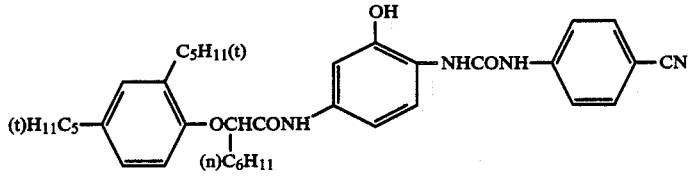

C-5

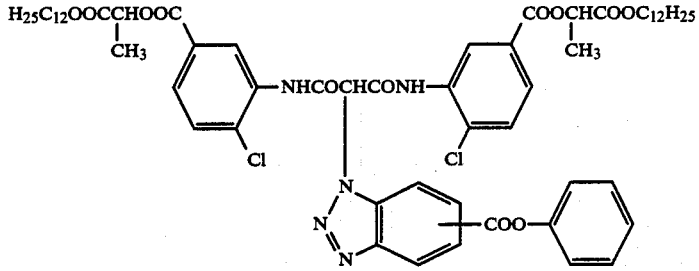

C-6

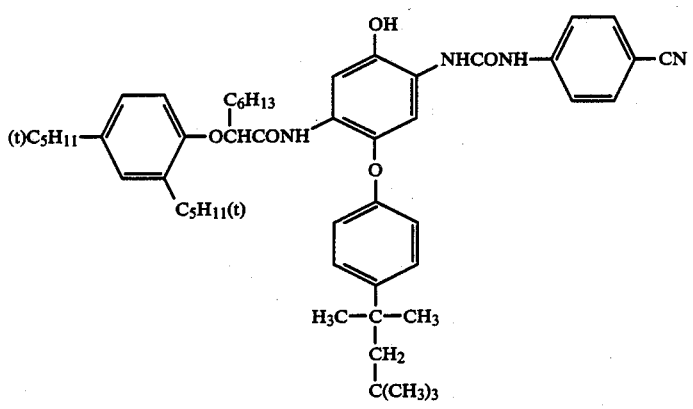

C-7

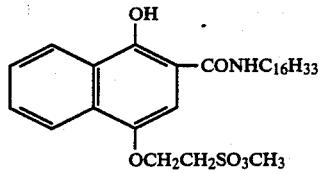

-continued

C-11

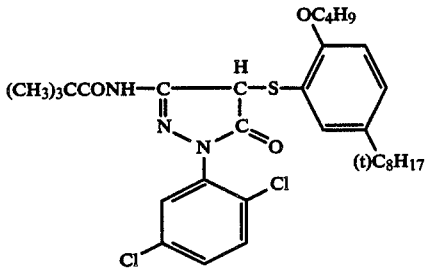

C-13

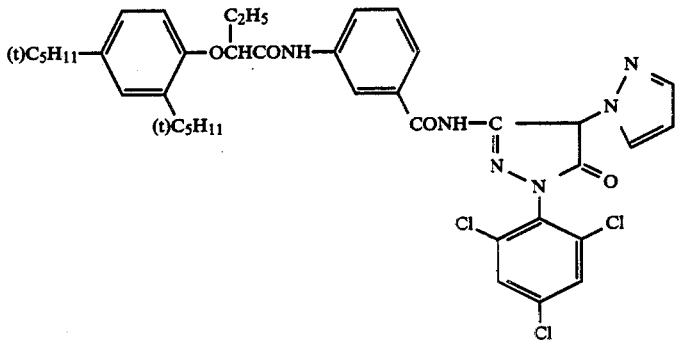

C-14

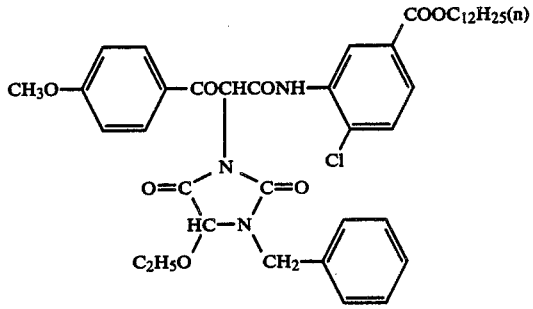

C-15

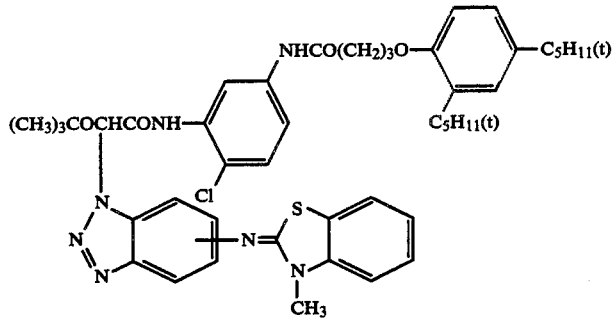

Other symbols showing other compounds indicated above have the same meanings as in Example 1.

Each of the samples thus prepared was wedge-exposed at 25 CMS using a tungsten light source adjusted to 4800° K. in color temperature with a filter and then processed at 38° C. According to the following processing steps.

Color Development Processing

| | |
|---|---|
| Color Development | 3 min. 15 sec. |
| Blix | 1 min. 00 sec. to 15 min. 00 sec. |
| Rinse | 2 min. |
| Stabilization | 40 sec. |

The compositions of the processing liquids used for the aforesaid steps were as follows.

Color Developer

Same composition and same pH as the color developer used in Example 1.

Blix Liquid

| | |
|---|---|
| Ethylenediaminetetraacetic Acid Ferric ammonium Salt | 100.0 g |
| Ethylenediaminetetraacetic Acid Disodium.Di-hydrate | 5.0 g |
| Sodium Sulfite | 10.0 g |
| Aqueous Solution of Ammonium Thiosulfate (70%) | 200.0 ml |

-continued

| | |
|---|---|
| Desilvering Accelerator (I-1) | 2.0 g |
| Water to make | 1.0 liter |
| | pH 6.9 |

Rinse Liquid

| | |
|---|---|
| Water | 1.0 liter |
| Ethylenediaminetetraacetic Acid Disodium Salt | 0.2 g |
| Sulfanylamide | 0.2 g |

Stabilizaton Liquid

Same as the composition of the stabilization liquid used in Example 1.

By measuring in the amount of silver remaining in the maximum density portion of each sample thus wedge exposed and processed as described above by fluorescent X-ray analysis, the blix completion time (the time of completing the desilvering) of each sample was determined. Also, after similarly exposing each sample as described above with light of 2 lux at a color temperature of 4800° K. for 1/100 sec., the sample was processed as described above and the granininess (RMS value) thereof was measured using an aperture of 48 micron. These results thus obtained are shown in Table 5 below.

TABLE 3

Content of Silver Iodobromide in Emulsion of Each Sample

| Sample No. | Layer 3 | Layer 4 | Layer 5 | Layer 7 | Layer 8 | Layer 9 | Layer 11 | Layer 12 |
|---|---|---|---|---|---|---|---|---|
| 201 | 2 | 5 | 3 | 4 | 5 | 3 | 4 | 4 |
| | (–) | (–) | (4/2) | (–) | (–) | (4/2) | (8/0) | (6/2) |
| 202 | 2 | 5 | 8 | 4 | 5 | 8 | 4 | 7 |
| | (–) | (–) | (16/0) | (–) | (–) | (16/0) | (8/0) | (13/1) |
| 203 to 208 | 2 | 5 | 8 | 4 | 5 | 8 | 4 | 11 |
| | (–) | (–) | (16/0) | (–) | (–) | (16/0) | (8/0) | (22/0) |

Note:
Upper: Mean Silver Iodide Content (mol %)
Lower: (AgI Content in Core/AgI Content in shell) (–) represents no clear core/shell structure.

TABLE 4

Addition Layer and Amount of Desilvering Accelerator

| Sample No. | Desilvering Accelerator-Added Layer | Compound I-1 (mol/l) | I-9 (mol/l) | III (mol/l) |
|---|---|---|---|---|
| 201 to 203 | not added | 0 | 0 | 0 |
| 204 | Layer 13 | 0 | $1 \times 10^{-3}$ | 0 |
| 205 | Layer 6 | 0 | $1 \times 10^{-3}$ | 0 |
| 206 | Layer 1 | 0 | $1 \times 10^{-3}$ | 0 |
| 207 | Layer 1 | $1 \times 10^{-3}$ | 0 | 0 |
| 208 | Layer 1 | 0 | 0 | $1 \times 10^{-3}$ |

TABLE 5

Desilvering Completion Time and Graininess (RMS Value) of Each Sample

| Sample No. | Desilvering Completion Time (min) | RMS Value Blue Filer Measurement | Green Filter Measurement | Red Filer Measurement |
|---|---|---|---|---|
| 201 | 3 | 0.035 | 0.022 | 0.016 |
| 202 | 8 | 0.028 | 0.014 | 0.012 |
| 203 | 10 | 0.025 | 0.014 | 0.012 |

TABLE 5-continued

Desilvering Completion Time and Graininess (RMS Value) of Each Sample

| Sample No. | Desilvering Completion Time (min) | RMS Value Blue Filer Measurement | Green Filter Measurement | Red Filer Measurement |
|---|---|---|---|---|
| 204 | 4 | 0.025 | 0.014 | 0.012 |
| 205 | 3.5 | 0.025 | 0.014 | 0.012 |
| 206 | 3 | 0.025 | 0.014 | 0.012 |
| 207 | 3 | 0.025 | 0.014 | 0.012 |
| 208 | 7 | 0.025 | 0.014 | 0.012 |

Note:
Samles Nos. 201 to 203 and 208 are the comparative samples, and others are the samples of the present invention.

From the results shown in Table 5, it can be seen that Comparison Sample 201 is inferior in graininess, Comparison Samples 202, 203, and 208 are inferior in desilvering property, while only Samples 204 to 207 of this invention simultaneously realize excellent graininess and quick desilvering.

EXAMPLE 4

Sample 203 in Example 3 described above was exposed and rocessed as in Example 3. In this case, 4 kinds of blix liquids were prepared by adding each of Desilvering Accelerators I-1, I-9 and III to the blix liquid as used in Example 3 above in the amounts shown in Table 6, respectively and used.

The desilvering completion time of Sample 203 in each processing obtained as in Example 3 described above is shown in Table 6 below.

TABLE 6

Content of desilvering acceleration in blix liquid and desilvering completion time

| | Blix Liquid a* | b** | c** | d* |
|---|---|---|---|---|
| I-1 | 0 | $5 \times 10^{-3}$ mol/liter | 0 | 0 |
| I-9 | 0 | 0 | $5 \times 10^{-3}$ mol/liter | 0 |
| III | 0 | 0 | 0 | $5 \times 10^{-3}$ mol/liter |
| Completion Time | 10 min. | 3 min. | 2 min. 50 sec. | 7 min. |

*Comparison Example,
**Example of the invention

From the results shown in Table 6 above, it can be seen that desilvering is completed in a short period of time in the case of using the blix liquid in this invention only.

EXAMPLE 5

A multilayer color photographic material having the layers of the compositions shown below on a cellulose triacetate film support having a subbing layer was prepared.

In addition, the coating amount (coverage) was shown by the unit of $g/m^2$ for silver halide emulsion and colloid silver, by the unit of $g/m^2$ for additives and gelatin, and by mol number per mol of silver halide in the layer for a sensitizing dye in the same layer.

Layer 1 (Antihalation Layer)

| | |
|---|---|
| Black Colloid Silver | 0.18 |
| Gelatin | 1.3 |
| Colored Coupler C-1 | 0.06 |
| Ultraviolet Absorbent UV-1 | 0.1 |
| Ultraviolet Absorbent UV-2 | 0.2 |
| Dispersing Oil Oil-1 | 0.01 |
| Dispersing Oil Oil-2 | 0.01 |

Layer 2 (Interlayer)

| | |
|---|---|
| Gelatin | 1.0 |
| Colored Coupler C-2 | 0.02 |
| Dispersing Oil Oil-1 | 0.1 |

Layer 3 (1st Red-Sensitive Emulsion Layer)

| | |
|---|---|
| Silver Iodobromide Emulsion (mean grain size 0.6 micron, AgI 6 mol %) | 0.72 |
| Gelatin | 0.6 |
| Sensitizing Dye I | $1.0 \times 10^{-4}$ |
| Sensitizing Dye II | $3.0 \times 10^{-4}$ |
| Sensitizing Dye III | $1.0 \times 10^{-5}$ |
| Coupler C-3 | 0.06 |
| Coupler C-4 | 0.06 |
| Coupler C-8 | 0.04 |
| Coupler C-2 | 0.03 |
| Dispersing Oil Oil-1 | 0.03 |
| Dispersing Oil Oil-3 | 0.012 |

Layer 4 (2nd Red-Sensitive Emulsion Layer)

| | |
|---|---|
| Silver Iodobromide Emulsion (mean grain size 0.9 micron, AgI 6 mol %) | 1.6 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-3 | 0.24 |
| Coupler C-4 | 0.24 |
| Coupler C-8 | 0.04 |
| Coupler C-2 | 0.04 |
| Dispersing Oil Oil-1 | 0.05 |
| Dispersing Oil Oil-3 | 0.10 |

Layer 5 (3rd Red-Sensitive Emulsion Layer)

| | |
|---|---|
| Silver Iodobromide Emulsion (mean grain size 1.2 microns, AgI 10 mol %) | 1.4 |
| Gelatin | 1.0 |
| Sensitizing Dye I | $1 \times 10^{-4}$ |
| Sensitizing Dye II | $3 \times 10^{-4}$ |
| Sensitizing Dye III | $1 \times 10^{-5}$ |
| Coupler C-6 | 0.05 |
| Coupler C-7 | 0.1 |
| Coupler C-2 | 0.03 |

-continued

| | |
|---|---|
| Dispersing Oil Oil-1 | 0.01 |
| Dispersing Oil Oil-2 | 0.05 |

Layer 6 (Interlayer)

| | |
|---|---|
| Gelatin | 1.0 |
| Compound Cpd-A | 0.03 |
| Dispersing Oil Oil-1 | 0.05 |
| Dispersing Oil Oil-2 | 0.05 |

Layer 7 (1st Green-Sensitive Emulsion Layer)

| | |
|---|---|
| Silver Iodobromide Emulsion (mean grain size 0.5 micron, AgI 5 mol %) | 0.60 |
| Sensitizing Dye IV | $5 \times 10^{-4}$ |
| Sensitizing Dye V | $2 \times 10^{-4}$ |
| Gelatin | 1.0 |
| Coupler C-12 | 0.2 |
| Coupler C-5 | 0.03 |
| Coupler C-9 | 0.02 |
| Coupler C-1 | 0.03 |
| Dispersing Oil Oil-1 | 0.5 |

Layer 8 (2nd Red-Sensitive Emulsion Layer)

| | |
|---|---|
| Silver Iodobromide Emulsion (mean grain size 0.8 micron, AgI 8 mol %) | 1.5 |
| Sensitizing Dye VI | $5 \times 10^{-4}$ |
| Sensitizing Dye V | $2 \times 10^{-4}$ |
| Coupler C-12 | 0.25 |
| Coupler C-1 | 0.03 |
| Coupler C-10 | 0.015 |
| Coupler C-5 | 0.03 |
| Dispersing Oil Oil-1 | 0.2 |

Layer 9 (3rd Green-Sensitive Emulsion Layer)

| | |
|---|---|
| Silver Iodobromide Emulsion (mean grain size 1.1 micron, AgI 10 mol %) | 1.5 |
| Gelatin | 1.0 |
| Sensitizing Dye IV | $3.5 \times 10^{-4}$ |
| Sensitizing Dye V | $1.4 \times 10^{-4}$ |
| Coupler C-11 | 0.05 |
| Coupler C-12 | 0.01 |
| Coupler C-13 | 0.08 |
| Coupler C-1 | 0.02 |
| Dispersing Oil Oil-1 | 0.10 |
| Dispersing Oil Oil-2 | 0.05 |

Layer 10 (Yellow Filter Layer)

| | |
|---|---|
| Gelatin | 1.2 |
| Yellow Colloid Silver | 0.08 |
| Compound Cpd-B | 0.1 |
| Dispersing Oil Oil-1 | 0.3 |

Layer 11 (1st Blue-Sensitive Emulsion Layer)

| | |
|---|---|
| Mono-Dispersed Silver Iodobromide Emulsion (mean grain size 0.4 micron, AgI 6 mol %) | 0.32 |
| Gelatin | 1.0 |
| Sensitizing Dye V | $2 \times 10^{-4}$ |
| Coupler C-14 | 0.9 |

-continued

| | |
|---|---|
| Coupler C-5 | 0.07 |
| Dispersing Oil Oil-1 | 0.2 |

Layer 12 (2nd Blue-Sensitive Emulsion Layer)

| | |
|---|---|
| Silver Iodobromide Emulsion (mean grain size 1.5 microns, AgI 10 mol %) | 0.40 |
| Gelatin | 0.6 |
| Sensitizing Dye V | $1 \times 10^{-4}$ |
| Coupler C-14 | 0.25 |
| Dispersing Oil Oil-1 | 0.07 |

Layer 13 (1st Protective Layer)

| | |
|---|---|
| Gelatin | 0.8 |
| Ultraviolet Absorbent UV-1 | 0.1 |
| Ultraviolet Absorbent UV-2 | 0.2 |
| Dispersing Oil Oil-1 | 0.01 |

-continued

| | |
|---|---|
| Dispersing Oil Oil-2 | 0.01 |

Layer 14 (2nd Protective Layer)

| | |
|---|---|
| Fine Grain Silver Bromide (mean grain size 0.07 micron) | 0.5 |
| Gelatin | 0.45 |
| Polymethyl methacrylate Particles (diameter 1.5 microns) | 0.2 |
| Hardening Agent H-1 | 0.4 |
| Formaldehyde Scavenger S-1 | 0.5 |
| Formaldehyde Scavenger S-2 | 0.5 |

Each of the above-described layers further contained a surface active agent as a coating aid and 4-hydroxy-6-methyl-(1,3,3*a*,7) tetraazaindene as a stabilizer in addition to the above components. The sample thus prepared was denoted as Sample 301.

Then, the chemical structures of the compounds used for the sample are shown below.

C-3

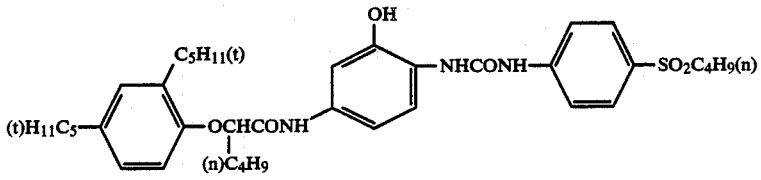

Same as C-4 in Example 3 — C-4

C-7

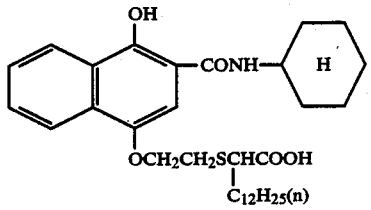

C-9

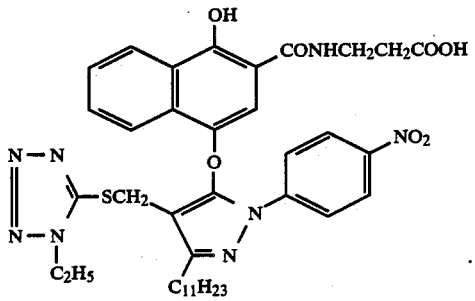

Same as C-11 in Example 3 — C-11

Cpd B

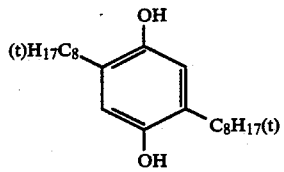

-continued

C-12

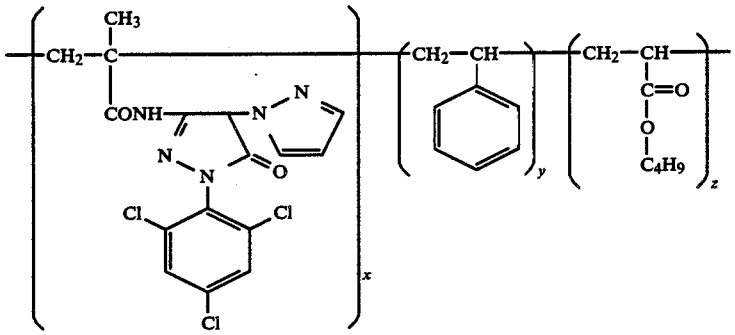

x:y:z = 2:1:1 Average molecular weight 40,000

Same as C-14 in Example 3

C-14

Sensitizing Dye V

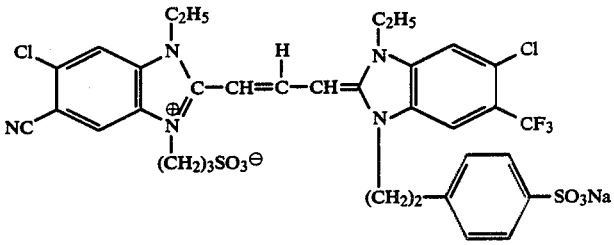

Sensitizing Dye IV

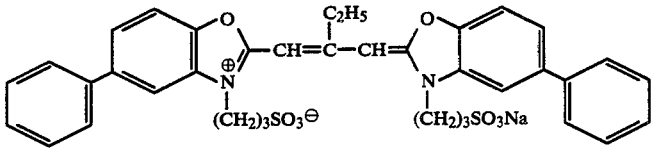

Sensitizing Dye VI

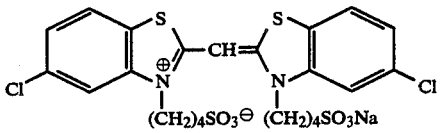

Other symbols showing other compounds than the above-described compounds have the same significance of the same symbols shown in Example 1.

Then, by following the same procedure as in the case of preparing Sample 301 except that each of the compounds of Formula (III) and the comparison compounds shown below to Layer 5, Layer 10, and Layer 13 of Sample 301 at the coverages of $4\times10^{-4}$ g/m$^2$, $2\times10^{-4}$ g/m$^2$, and $1\times10^{-4}$ g/m$^2$, respectively, Samples 301 to 305 were prepared.

Sample 302: Compound (III)-11 of this invention.

Sample 302: Comparison Compound (III)-11A

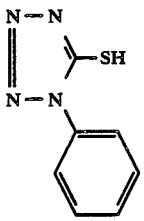

Sample 304: Compound (III)-28 of this invention.

Sample 305: Comparison Compound (III)-28A

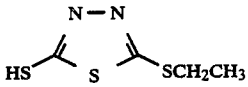

Storability Test

Directly after the preparation of each of Samples 301 to 305 or after storing each sample for 3 days at 60° C. and 30% RH, each sample was processed by processing conditions (I) and (II) shown below and the sensitivity and fog were measured, whereby the storability of the sample was determined. The results obtained are shown in Table 7 below.

In Table 7, the relative sensitivity is the sensitivity of each layer of each sample with the sensitivity of each layer of Sample 301 directly after the preparation thereof being shown as standard (100). Also, in Table 7, BL, GL, and RL show a blue-sensitive emulsion layer, a green-sensitive emulsion layer, and a red-sensitive emulsion layer, respectively.

Desilvering Test

After applying uniform exposure of 25 CMS to each of Samples 301 to 305 using a tungsten lamp adjusted to 4800° K. in color temperature with a filter, the sample was processed under processing condition (I)-(A), (I)-(B), (I)-(C) or (I)-(D) shown below at the bleaching time shown in Table 8 below, the amount of silver remaining in each film sample was measured by X-ray fluorescent analysis. These results obtained are shown in Table 8 below.

Also, the above-described procedure was followed in processing step (II) shown below at the bleach time and blix time shown in Table 9 and the results obtained are shown in Table 9 below.

TABLE 7

| Sample No. | Compound Added to Layers 5, 9, and 13 | | Immediately after Preparing Sample: Fog | Immediately after Preparing Sample: Relative Sensitivity | After Storage for 3 Days at 60° C., 30% RH: Fog | After Storage for 3 Days at 60° C., 30% RH: Relative Sensitivity |
|---|---|---|---|---|---|---|
| 301 | — | BL | ±0* | 100* | +0.17 | 72 |
| | | GL | ±0* | 100* | +0.24 | 65 |
| | | RL | ±0* | 100* | +0.20 | 70 |
| 302 | (III-11) | BL | −0.03 | 100 | +0.05 | 100 |
| | | GL | −0.03 | 101 | +0.07 | 95 |
| | | RL | −0.04 | 102 | +0.06 | 101 |
| 303 | Comparison Compound (III-11A) | BL | −0.04 | 97 | +0.03 | 95 |
| | | GL | −0.03 | 99 | +0.04 | 90 |
| | | RL | −0.05 | 100 | +0.04 | 93 |
| 304 | (III-28) | BL | −0.03 | 100 | +0.05 | 100 |
| | | GL | −0.03 | 100 | +0.06 | 96 |
| | | RL | −0.05 | 101 | +0.04 | 100 |
| 305 | Comparison Compound (III-28A) | BL | −0.03 | 100 | +0.03 | 97 |
| | | GL | −0.04 | 96 | +0.05 | 92 |
| | | RL | −0.05 | 100 | +0.03 | 97 |

Note:
*Fog values and relative sensitivities of Sample No. 301 immediately after preparation are taken as the standard.
Sample Nos. 302 and 304 are the samples of the present invention.

TABLE 8

| Experiment No. | Sample No. | Processing Step I: Bleach Liquid | Processing Step I: Bleaching Time | Residual Silver Amount (μg/cm²) |
|---|---|---|---|---|
| 1 | 301 | (A) | 1 min 30 sec | 15 |
| 2 | | (B) | " | 2 |
| 3 | | (C) | " | 7 |
| 4 | | (D) | " | 1 |
| 5 | 302 | (A) | " | 14 |
| 6 | | (B) | " | 2 |
| 7 | | (C) | " | 6 |
| 8 | | (D) | " | 1 |
| 9 | 303 | (A) | " | 23 |
| 10 | | (B) | " | 12 |
| 11 | | (C) | " | 14 |
| 12 | | (D) | " | 9 |
| 13 | 304 | (A) | " | 15 |
| 14 | | (B) | " | 2 |
| 15 | | (C) | " | 8 |
| 16 | | (D) | " | 1 |
| 17 | 305 | (A) | " | 22 |
| 18 | | (B) | " | 11 |
| 19 | | (C) | " | 15 |
| 20 | | (D) | " | 10 |

Note:
Experiment Nos. 1 to 5, 9 to 13, and 17 to 20 are the comparative experiments, and others are the experiments according to the present invention.

TABLE 9

| Experiment No. | Sample No. | Processing Step II: Bleach Liquid | Processing Step II: Bleach Time | Processing Step II: Blix Liquid | Processing Step II: Blix Time | Residual Silver Amount (μg/cm²) |
|---|---|---|---|---|---|---|
| 21 | 301 | — | — | (A) | 2 min | 12 |
| 22 | 302 | — | — | " | " | 11 |
| 23 | 303 | — | — | " | " | 18 |
| 24 | 304 | — | — | " | " | 11 |
| 25 | 305 | — | — | " | " | 17 |

TABLE 9-continued

| Experiment No. | Sample No. | Processing Step II: Bleach Liquid | Processing Step II: Bleach Time | Processing Step II: Blix Liquid | Processing Step II: Blix Time | Residual Silver Amount (μg/cm²) |
|---|---|---|---|---|---|---|
| 26 | 301 | (D) | 30 sec | (A) | 1 min 30 sec | 8 |
| 27 | 302 | " | " | " | " | 4 |
| 28 | 303 | " | " | " | " | 13 |
| 29 | 304 | " | " | " | " | 4 |
| 30 | 305 | " | " | " | " | 12 |
| 31 | 301 | (D) | 30 sec | (B) | 1 min 30 sec | 3 |
| 32 | 302 | " | " | " | " | 2 |
| 33 | 303 | " | " | " | " | 7 |
| 34 | 304 | " | " | " | " | 2 |
| 35 | 305 | " | " | " | " | 7 |

Note:
Experiment Nos. 21 to 26, 28, 30, 31, 33, and 35 are the comparative experiments, and others are the experiments according to the present invention.

From the results shown in Table 7, Table 8, and Table 9 described above, it can be seen that by adding the compound of formula (III) of this invention to the color photographic material and adding the compound of formula (I) of this invention to the bleach liquid or the blix liquid, a color photographic processing showing less change of performance when the color photographic material is stored for a long period of time and showing excellent desilvering property is obtained.

The processing steps used above was as follows.

Processing Step (I)

| | |
|---|---|
| 1. Color Development | 3 min. 15 sec. |
| 2. Bleach | 6 min. 30 sec. if otherwise indicated |
| 3. Wash | 3 min. 15 sec. |
| 4. Fix | 6 min. 30 sec. |
| 5. Wash | 3 min. 15 sec. |
| 6. Stabilization | 3 min. 15 sec. |

Processing Step (II)

| | |
|---|---|
| 1. Color Development | 3 min. 15 sec. |
| 2. Bleach | shown in Table 9 |
| 3. Blix | shown in Table 9 |
| 4. Rinse | 1 min. 40 sec. |

-continued

| | |
|---|---|
| 5. Stabilization | 40 sec. |

The compositions of the processing liquids used in the processing steps described above were processing steps described above were as follows.

Color Developer

Same composition as the color developer used in Example 1.

Bleach Liquid

Same composition as the bleach liquid used in Example 1.

Bleach Liquid (B)

A liquid obtained by adding $5\times10^{-3}$ mol/liter of Bleach Accelerator (I)-(1) of this invention to Bleach Liquid (A) described above.

Bleach Liquid

| | | |
|---|---|---|
| Ethylenediaminetetraacetic Acid Stannic Ammonium Salt | 100.0 g | |
| Ethylenediaminetetraacetic Acid Disodium Salt | 10.0 g | |
| Ammonium Bromide | 150.0 g | |
| Ammonium Nitrate | 10.0 g | |
| Aqueous Ammonia (28%) | 3.0 ml | |
| Water to make | 1.0 liter | |
| pH | 5.5 | |

Bleach Liquid (D)

A liquid obtained by adding $5\times10^{-3}$ mol/liter of Bleach Accelerator (I)-(1) of this invention to Bleach Liquid (C).

Bleach Liquid (E)

| | | |
|---|---|---|
| Ammonium Bromide | 100 g | |
| Ethylenediaminetetraacetic Acid Ferric Ammonium Salt | 120.0 g | |
| Ethylenediaminetetraacetic Acid Disodium Salt | 10.0 g | |
| Ammonium Nitrate | 10.0 g | |
| Bleach Accelerator (II)-(2) | 2.0 g | |
| Aqueous Ammonia | 17.0 ml | |
| Water to make | 1.0 liter | |
| pH | 6.5 | |

The flix liquid and the stabilization liquid were same as those used in Example 1.

-continued

| | |
|---|---|
| Ethylenediaminetetraacetic Acid Ferric Ammonium Salt | 80.0 g |
| Ethylenediaminetetraacetic Acid Disodium Salt | 10.0 g |
| Sodium Sulfite | 12.0 g |
| Aqueous Solution of Ammonium Thiosulfate (70%) | 17.0 ml |
| Water to make | 1.0 liter |
| pH adjusted to 6.8 with aqueous ammonia (28%) | |

Blix Liquid (B)

A liquid obtained by adding 1.5 g of Bleach Accelerator (I)-(1) of this invention to Blix Liquid (A)

Rinse Liquid

| | |
|---|---|
| Ethylenediaminetetraacetic Acid Di-sodium Salt | 0.4 g |
| Water to make | 1.0 liter |
| pH adjusted to 7.0 with sodium hydroxide. | |

Stabilization Liquid

| | |
|---|---|
| Formalin (37% W/V) | 2.0 ml |
| Polyoxyethylene-p-monononyl Phenyl Ether | 0.3 g |
| Water to make | 1.0 liter |

EXAMPLE 6

By following the same procedures as the case of preparing Samples 301 to 305 in Example 5 except that Compound (I)-(1) of this invention was added to Layer 1 of the samples at a coverage of $1\times10-3$ mol/m$^2$, Samples 311 to 315 were prepared.

Also, by following the same procedures as the case of preparing Samples 301 to 305 in Example 5 except that Compound (II)-(2) of this invention was added to Layer 2 of the samples at a coverage of $1\times10\ -3$ mol/m$^2$, Samples 321 to 325 were prepared.

On Samples 311 to 315 and Samples 321 to 325, to stroability test as in Example 5 was applied and the results obtained are shown in Table 10 below. The relative sensitivity in Table 10 was the same as in Table 7 in Example 5.

Desilvering Test

After applying uniform exposure of 25 CMS to each of Samples 301 in Example 5 and Samples 311 to 315 and 321 to 325 using a tungsten lamp adjusted to 4800° K. in color temperature with a filter, the samples of processed under processing condition (I)-(A) or (I)-(B) at the leaching time shown in Table 11 below and then the amount of silver remaining in each film sample was measured by X-ray fluorescent analysis. The results obtained are shown in Table 11 below.

TABLE 10

| Sample No. | Compound Added to Layers 5, 9, and 13 | | Immediately after Preparing Sample: Fog | Immediately after Preparing Sample: Relative Sensitivity | After Storage for 3 Days at 60° C., 30% RH: Fog | After Storage for 3 Days at 60° C., 30% RH: Relative Sensitivity |
|---|---|---|---|---|---|---|
| 301 | — | BL | ±0* | 100* | +0.17 | 72 |
| | | GL | ±0* | 100* | +0.24 | 65 |
| | | RL | ±0* | 100* | +0.20 | 70 |
| 311 | — | BL | ±0 | 100 | +0.18 | 69 |
| | | GL | +0.01 | 101 | +0.26 | 64 |
| | | RL | +0.02 | 99 | +0.22 | 68 |
| 312 | (III-11) | BL | −0.03 | 100 | +0.05 | 100 |

TABLE 10-continued

| Sample No. | Compound Added to Layers 5, 9, and 13 | | Immediately after Preparing Sample Fog | Relative Sensitivity | After Storage for 3 Days at 60° C., 30% RH Fog | Relative Sensitivity |
|---|---|---|---|---|---|---|
| | | GL | −0.03 | 101 | +0.07 | 95 |
| | | RL | −0.02 | 100 | +0.07 | 100 |
| 313 | Comparison Compound | BL | −0.04 | 97 | +0.03 | 95 |
| | (III-11A) | GL | −0.03 | 99 | +0.04 | 90 |
| | | RL | −0.03 | 99 | +0.06 | 93 |
| 314 | (III-28) | BL | −0.03 | 100 | +0.05 | 100 |
| | | GL | −0.03 | 100 | +0.06 | 96 |
| | | RL | −0.04 | 100 | +0.05 | 101 |
| 315 | Comparative Compound | BL | −0.03 | 100 | +0.03 | 97 |
| | (III-28A) | GL | −0.04 | 96 | +0.05 | 92 |
| | | RL | −0.04 | 99 | +0.04 | 99 |
| 321 | — | BL | ±0 | 100 | +0.16 | 74 |
| | | GL | ±0 | 101 | +0.25 | 65 |
| | | RL | ±0 | 100 | +0.18 | 73 |
| 322 | (III-11) | BL | −0.03 | 100 | +0.05 | 100 |
| | | GL | −0.03 | 101 | +0.07 | 95 |
| | | RL | −0.05 | 103 | +0.05 | 102 |
| 323 | Comparative Compound | BL | −0.04 | 97 | +0.03 | 95 |
| | (III-11A) | GL | −0.03 | 99 | +0.04 | 90 |
| | | RL | −0.06 | 101 | +0.05 | 95 |
| 324 | (III-28) | BL | −0.03 | 100 | +0.05 | 100 |
| | | GL | −0.03 | 100 | +0.06 | 96 |
| | | RL | −0.05 | 102 | +0.05 | 101 |
| 325 | Comparative Compound | BL | −0.03 | 100 | +0.03 | 97 |
| | (III-28A) | GL | −0.04 | 96 | +0.05 | 92 |
| | | RL | −0.05 | 101 | +0.04 | 100 |

Note:
*Fog values and relative sensitivities of Sample No. 301 immediately after preparation are taken as the standard.
Sample Nos. 312 and 314 are the samples of the present invention.
Sample Nos. 322 and 324 are the samples of the present invention.

TABLE 11

| Experiment No. | Sample No. | Processing Step I Bleach Liquid | Bleaching Time ($\mu g/cm^2$) | Residual Silver Amount |
|---|---|---|---|---|
| 36 | 301 | (A) | 1 min | 35 |
| 37 | | (B) | " | 18 |
| 38 | 311 | (A) | " | 5 |
| 39 | | (B) | " | 2 |
| 40 | 312 | (A) | " | 4 |
| 41 | | (B) | " | 1 |
| 42 | 313 | (A) | " | 14 |
| 43 | | (B) | " | 9 |
| 44 | 314 | (A) | " | 4 |
| 45 | | (B) | " | 1 |
| 46 | 315 | (A) | " | 15 |
| 47 | | (B) | " | 9 |
| 48 | 321 | (A) | " | 6 |
| 49 | | (B) | " | 3 |
| 50 | 322 | (A) | " | 5 |
| 51 | | (B) | " | 1 |
| 52 | 323 | (A) | " | 16 |
| 53 | | (B) | " | 11 |
| 54 | 324 | (A) | " | 5 |
| 55 | | (B) | " | 2 |
| 56 | 325 | (A) | " | 15 |
| 57 | | (B) | " | 10 |

Note:
Experiment Nos. 36 to 39, 42, 43, 46 to 49, 52, 53, 56, and 57 are the comparative experiments, and others are the experiments according to the present invention.

From the results shown in Table 10 and Table 11 above, it can be seen that by adding the compound of general formula (III) to a color photographic material together with the compound of general formula (I) or (I) of this invention, the color photographic material showing less change of performance in the case of storing the color photographic material for a long period of time and showing excellent desilvering property is obtained.

As described above, according to this invention, color photoraphic materials and color photographic processing process showing less change of performance in the case of storing the color photographic materials for a long period of time and quickly performing desilvering can be obtained.

While the invention has been described in detail and with reference to specific examples thereof, it will be apparent to one skilled in the art that various changes and modifications can be made therein without departing from the spirit and scope thereof.

What is claimed is:

1. A silver halide color photographic material having on a support at least one light-sensitive silver halide emulsion layer containing at least one phenolic cyan dye forming coupler having an arylureido group at the 2-position and a carbonamido group at the 5-position thereof, said color photographic material further contains at least one of a compound represented by formula (I) and/or a compound represented by formula (II), and also a compound represented by formula (III);

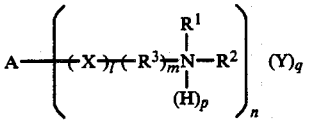

(I)

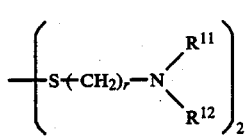

(II)

wherein A represents an n-valent aliphatic linkage group, an aromatic linkage group or a heterocyclic group; X represents —O—, —S—, or

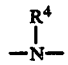

(wherein, $R^4$ represents a lower alkyl group); $R^1$ and $R^2$, each represents a substituted or unsubstituted lower alkyl group; $R^3$ represents a lower alkylene group; said $R^1$ and $R^2$ said $R^1$ and A, said $R^1$ and $R^3$, said $R^2$ and A, or said $R^2$ and $R^3$ combine with each other to form a ring; Y represents an anion; l represents 0 or 1; m represents 0 or 1; n represents 1, 2, or 3; p represents 0 or 1; q represents 0, 1, 2, or 3; when n is 2 or 3, the substituents bonding to A are the same or different; r represents 1, 2, or 3; $R^{11}$ and $R^{12}$ each represents a hydrogen atom, an alkyl group, or an acyl group, except that $R^{11}$ and $R^{12}$ do not both represent a hydrogen atom at the same time; or $R^{11}$ and $R^{12}$ combine with each other to form a ring;

$Q—SM^1$ (III)

wherein Q represents a heterocyclic residue bonded directly or indirectly with at least one of $—SO_3M^2$, $—COOM^2$, —OH, and $—NR^{21}R^{22}$ (wherein $M^2$ represents a hydrogen atom, an alkali metal, a quaternary ammonium, or a quaternary phosphonium and $R^{21}$ and $R^{22}$ each represents a hydrogen atom or a substituted or unsubstituted alkyl group) and $M^1$ represents a hydrogen atom, an alkali metal, a quaternary ammonium, or a quaternary phosphonium;

wherein said silver halide emulsion layer contains a mono-dispersed silver halide emulsion wherein at least 95% by weight or number of silver halide grains in the emulsion have grain sizes within ±40% of the mean grain size; and said phenolic cyan dye forming coupler is represented by formula (IV)

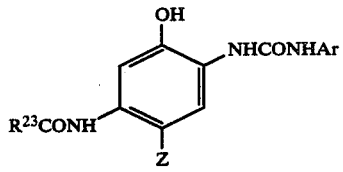

(IV)

wherein $R^{23}$ represents an aliphatic group, an aromatic group, or a heterocyclic group; Ar represents a substituted or unsubstituted aryl group; and Z represents a hydrogen atom or a group capable of releasing by a coupling reaction with the oxidation product of an aromatic primary amine developing agent.

2. A silver halide color photographic material as in claim 1, wherein said compound represented by formula (III) is a compound represented by formula (VI) or a compound represented by formula (VII)

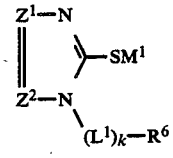

(VI)

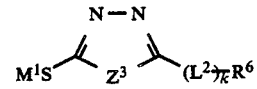

(VII)

wherein $Z^1$ and $Z^2$ each represents a nitrogen atom or C-$R^7$ (wherein $R^7$ represents a hydrogen atom, a substituted on unsubstituted alkyl group, or a substituted or unsubstituted aryl group); $R^6$ represents an organic group substituted by at least one of $—SO_3M^2$, $—COOM^2$, —OH, and $—NR^{21}R^{22}$; $L^1$ represents a linkage group selected from —S—, —O—,

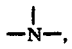

—CO—, —SO—, and $—SO_2—$; k represents 0 or 1; $M^2$ represents a hydrogen atom, an alkali metal, a quaternary ammonium, or a quaternary phosphonium; $R^{12}$ and $R^{22}$ each represents a hydrogen atom or a substituted or unsubstituted alkyl group; $M^1$ represents a hydrogen atom, an alkali metal, a quaternary ammonium, or quaternary phosphonium; $Z^3$ represents a sulfur atom, an oxygen atom, or

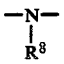

(wherein $R^8$ represents a hydrogen atom, a substituted or unsubstituted alkyl group, or a substituted or unsubstituted aryl group); and $L^2$ represents $—CONR^9—$, $—NR^9CO—$, $—NR^9SO_2—$, —OCO—, —COO—, —S—, $—NR^9—$, —CO—, —SO—, —OCOO—, $—NR^9CONR^{10}—$, $—OCONR^9—$, or $—NR^9SO_2NR^{10}$ (wherein $R^9$ and $R^{10}$ each represents a hydrogen atom, a substituted or unsubstituted alkyl group, or a substituted or unsubstituted aryl group).

3. A silver halide color photographic material as in claim 2, wherein $R^6$ represents $—SO_3M^2$ or $—COOM^2$ where $M^2$ represents a hydrogen atom, an alkali metal, a quaternary ammonium, or a quaternary phosphonium.

4. A silver halide color photographic material as in claim 1, wherein said at least one light-sensitive silver halide emulsion layer contains silver halide grains composed of a core substantially comprising silver iodobromide containing at least 10 mol% silver iodide and a shell substantially comprising silver bromide or silver iodobromide containing at most 5 mol% silver iodide.

5. A silver halide color photographic material as in claim 1, wherein said color photographic material contains a compound represented by formula (I) as defined in claim 1.

* * * * *